US010676115B2

(12) United States Patent
Mathews, Jr. et al.

(10) Patent No.: US 10,676,115 B2
(45) **Date of Patent: *Jun. 9, 2020**

(54) MULTIPLE VEHICLE CONTROL SYSTEM

(71) Applicant: GE Global Sourcing LLC, Norwalk, CT (US)

(72) Inventors: Harry Kirk Mathews, Jr., Niskayuna, NY (US); Brian Nedward Meyer, Fairview, PA (US); James D. Brooks, Schenectady, NY (US); Joseph Daniel Wakeman, Lawrence Park, PA (US); Dan Dai, Niskayuna, NY (US); Anup Menon, Niskayuna, NY (US)

(73) Assignee: GE GLOBAL SOURCING LLC, Norwalk, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/212,166

(22) Filed: Dec. 6, 2018

(65) Prior Publication Data

US 2019/0106133 A1 Apr. 11, 2019

Related U.S. Application Data

(63) Continuation of application No. 15/086,403, filed on Mar. 31, 2016, now Pat. No. 10,183,684.

(51) Int. Cl.
*B61L 3/00* (2006.01)
*B61L 15/00* (2006.01)

(52) U.S. Cl.
CPC ..... *B61L 3/008* (2013.01); *B61L 3/006* (2013.01); *B61L 15/0072* (2013.01); *B61L 15/0081* (2013.01)

(58) Field of Classification Search
CPC .. B61L 3/006; B61L 3/008; B61L 3/16; B61L 15/0027; B61L 15/0072; B61L 15/0081; B61L 25/00; B61L 25/02; B61L 25/021; B61L 25/025; B61L 25/026; B61L 27/0016; B61L 27/0022; B61L 27/0038; B61L 27/0094; B60L 2240/40; B60L 2240/42; B60L 2240/421; B60L 2240/423; B60L 2240/70; B60W 20/10; B60W 20/11; B60W 20/12; B60W 2550/40; B60W 2550/402; B60W 2550/408; G08G 1/20; G08G 1/16; G08G 1/22; G05D 1/0295

(Continued)

(56) References Cited

U.S. PATENT DOCUMENTS 5,136,516 A * 8/1992 Twombly ..... B61C 17/04 246/1 C
5,754,428 A * 5/1998 Ishikawa ..... B60W 10/06 477/37

(Continued)

*Primary Examiner* — Richard A Goldman
(74) *Attorney, Agent, or Firm* — Joseph M. Butscher; The Small Patent Law Group LLC

(57) ABSTRACT

A system includes one or more processors that are configured to obtain a constraint on movement for a first vehicle system along a route. The constraint is based on movement of a separate second vehicle system that is concurrently traveling along the same route. The processor(s) are configured to determine a speed profile that designates speeds for the first vehicle system according to at least one of distance, location, or time based on the constraint such that the first vehicle system maintains a designated spacing from the second vehicle system along the route.

20 Claims, 6 Drawing Sheets

(58) Field of Classification Search
USPC ..... 701/20, 19, 123, 36, 400, 408, 117, 300, 701/301, 96; 342/457
See application file for complete search history.

(56) References Cited

U.S. PATENT DOCUMENTS 5,864,285 A * 1/1999 Wieder ..... B60T 7/22 340/435
6,070,682 A * 6/2000 Isogai ..... B60K 31/0008 180/167
6,188,950 B1 * 2/2001 Tsutsumi ..... B60K 31/0008 180/170
6,256,574 B1 * 7/2001 Prestl ..... B60K 31/0008 180/170
6,339,740 B1 * 1/2002 Seto ..... B60K 31/0008 340/904
6,360,158 B1 * 3/2002 Hanawa ..... B60K 31/0008 180/179
6,622,810 B2 * 9/2003 Labuhn ..... B60K 31/0008 180/169
6,631,322 B1 * 10/2003 Arthur ..... B61L 27/0027 340/991
7,054,467 B1 * 5/2006 Honda ..... G01S 3/784 382/104
7,127,336 B2 * 10/2006 Houpt ..... B61L 3/002 701/19
7,539,624 B2 * 5/2009 Matheson ..... B61L 27/0016 705/7.22
8,155,868 B1 * 4/2012 Xing ..... G07C 5/0808 340/439
8,676,410 B2 * 3/2014 Houpt ..... B61L 27/0027 701/19
8,768,543 B2 * 7/2014 Kumar ..... B61L 27/0027 701/19
10,183,684 B2 * 1/2019 Mathews, Jr. ..... B61L 3/008
2002/0032514 A1 * 3/2002 Kuroda ..... B60K 31/0008 701/96
2003/0105573 A1 * 6/2003 Ishizu ..... B60K 31/0008 701/93
2003/0105574 A1 * 6/2003 Ino ..... B60K 31/0008 701/93
2003/0111902 A1 * 6/2003 Thiede ..... B60K 31/0008 303/193
2004/0199327 A1 * 10/2004 Isogai ..... B60T 7/22 701/301
2006/0005738 A1 * 1/2006 Kumar ..... B60L 7/06 105/35
2008/0270023 A1 * 10/2008 Kumar ..... B60L 15/2045 701/22
2009/0037058 A1 * 2/2009 Senneff ..... A01B 79/005 701/50
2010/0019718 A1 * 1/2010 Salasoo ..... B60L 3/0046 320/103
2010/0023232 A1 * 1/2010 Isaji ..... B60W 30/146 701/70
2011/0196591 A1 * 8/2011 Kuze ..... B60W 30/16 701/96
2012/0022764 A1 * 1/2012 Tang ..... B60W 10/06 701/102
2012/0203440 A1 * 8/2012 Matsunaga ..... B60T 7/12 701/93
2013/0018536 A1 * 1/2013 Cooper ..... B61L 3/006 701/20
2013/0138319 A1 * 5/2013 Schuberth ..... B60W 30/143 701/93
2014/0277860 A1 * 9/2014 Pulliam ..... B60L 15/20 701/19
2014/0379213 A1 * 12/2014 Otake ..... G08G 1/09626 701/36
2015/0142285 A1 * 5/2015 Nagata ..... G08G 1/167 701/70
2015/0232097 A1 * 8/2015 Luther ..... B61L 3/006 701/123
2015/0300830 A1 * 10/2015 Fisher ..... B61C 17/12 701/123
2016/0047656 A1 * 2/2016 Napolitano ..... B60L 7/24 701/400
2016/0119799 A1 * 4/2016 Hutchins ..... B61L 27/0027 455/67.7
2016/0264120 A1 * 9/2016 Kellner ..... B60T 17/228
2016/0304080 A1 * 10/2016 Sugiyama ..... B60W 20/20
2016/0318531 A1 * 11/2016 Johnson ..... B61L 25/02
2017/0122244 A1 * 5/2017 Dufford ..... F02D 11/105
2017/0210386 A1 * 7/2017 Kou ..... B60K 17/35
2018/0093650 A1 * 4/2018 Payne ..... B60T 8/172

* cited by examiner

MULTIPLE VEHICLE CONTROL SYSTEM

CROSS-REFERENCE TO RELATED APPLICATIONS

This application is a continuation of U.S. patent application Ser. No. 15/086,403, which was filed 31 Mar. 2016, now U.S. Pat. No. 10,183,684, and the entire disclosure of which is incorporated herein by reference.

FIELD

Embodiments of the subject matter described herein relate to vehicle control systems, and more particularly, to controlling movement of one or more vehicle systems along a route based on satisfying designated objectives and maintaining a designated spacing from other vehicles on the route.

BACKGROUND

A vehicle transportation system may include multiple vehicles that travel on the same routes. The vehicles may have different characteristics, such as power outputs and weights, that affect how quickly the vehicles can navigate through the routes. A trailing vehicle traveling along a given route may reduce the distance between the trailing vehicle and a slower-moving vehicle ahead of the trailing vehicle along the same route. The trailing vehicle has an incentive to reduce the total trip time in order to meet a designated arrival time at a destination, improve fuel economy, reduce emissions, and the like. Therefore, the trailing vehicle may move according to a trip plan that factors various objectives, such as reducing travel time, reducing fuel consumption, reducing emissions, and the like, while satisfying designated hard constraints, such as upper speed limits. The trailing vehicle traveling according to a trip plan may cause the trailing vehicle to creep up on the vehicle ahead. If the trailing vehicle gets too close to the vehicle ahead, the trailing vehicle may be required to slow to a stop for a designated period of time in order to avoid the risk of an accident between the two vehicles by increasing the distance therebetween. For example, if the vehicles are trains traveling in the same direction on a single track, they are required to avoid occupying the same section of track, called a block. If the trailing vehicle approaches a block that is occupied by the vehicle ahead, the trailing vehicle may be forced to stop before entering the occupied block. The stop is undesirable because such a stop may result in a significant delay that frustrates the ability of the trailing vehicle to satisfy the various objectives, such as reducing travel time, reducing fuel economy, arriving at a destination at or before a prescribed arrival time, and/or the like. Furthermore, having to stop indicates that the trailing vehicle could have reduced speed during an earlier segment of the trip, which could have resulted in considerable fuel savings while arriving at a destination at a similar time as the trailing vehicle traveling faster but having to stop. Due to required slow orders or stops every time the trailing vehicle approaches the vehicle ahead, the trailing vehicle may move along the route in an undesirable "hurry up and wait" manner.

BRIEF DESCRIPTION

In an embodiment, a system (e.g., a vehicle control system) includes an energy management system disposed onboard a first vehicle system configured to travel on a route during a trip. The energy management system has one or more processors. The energy management system is configured to receive trip information that is specific to the trip. The trip information includes one or more constraints including at least one of speed, distance, or time restrictions for the first vehicle system along the route. The energy management system is further configured to generate a trip plan for controlling movement of the first vehicle system along the route during the trip. The trip plan is generated based on the one or more constraints. The trip plan has a plan speed profile that designates speeds for the first vehicle system according to at least one of distance or time during the trip. The energy management system is further configured to control movement of the first vehicle system during the trip according to the plan speed profile of the trip plan.

In another embodiment, a system (e.g., a vehicle control system) includes one or more processors configured to receive trip information from a communication circuit onboard a first vehicle system that is configured to travel on a route during a trip. The trip information includes a pacing speed profile that is based on movement of at least a second vehicle system on the route. The one or more processors are further configured to generate a trip plan for controlling movement of the first vehicle system along the route during the trip. The trip plan has a plan speed profile that designates speeds for the first vehicle system according to at least one of distance or time during the trip. The trip plan is generated using one or more constraints that are based on the pacing speed profile. The one or more processors are further configured to control movement of the first vehicle system during the trip according to the plan speed profile of the trip plan to ensure that the first vehicle system maintains at least a designated separation from the second vehicle system during the trip.

In another embodiment, a method (e.g., for controlling a vehicle system) includes receiving trip information specific to a trip of a first vehicle system that is configured to travel on a route during a trip. The trip information includes one or more constraints including at least one of speed, distance, or time restrictions for the first vehicle system along the route. The method includes generating a trip plan for controlling movement of the first vehicle system along the route during the trip. The trip plan is generated based on the one or more constraints. The trip plan has a plan speed profile that designates speeds for the first vehicle system according to at least one of distance or time during the trip. The method also includes controlling movement of the first vehicle system during the trip according to the plan speed profile of the trip plan.

BRIEF DESCRIPTION OF THE DRAWINGS

The present inventive subject matter will be better understood from reading the following description of non-limiting embodiments, with reference to the attached drawings, wherein below.

DETAILED DESCRIPTION

Figure 1:
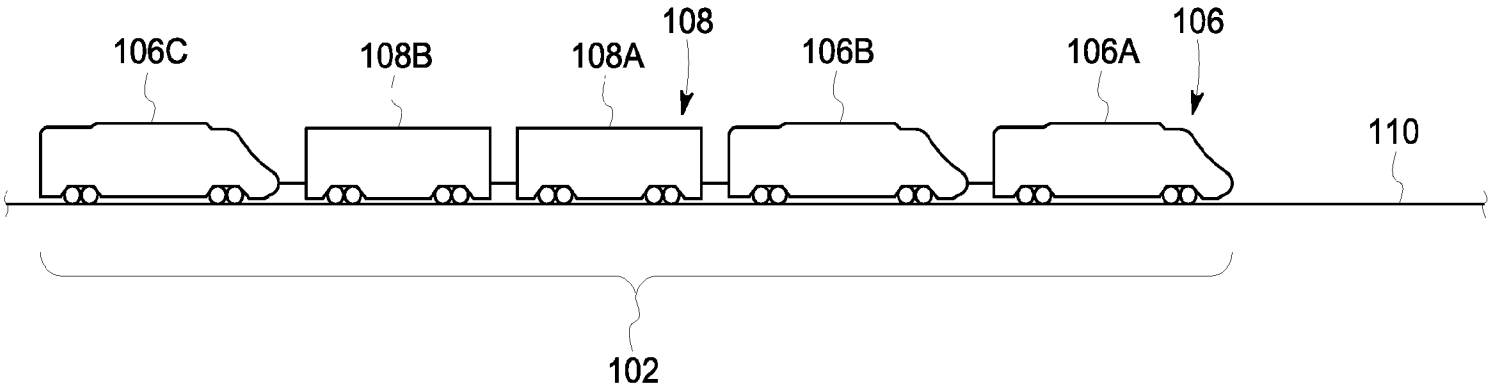
FIG. 1 illustrates one embodiment of a vehicle system.

As used herein, an element or step recited in the singular and proceeded with the word "a" or "an" should be understood as not excluding plural of said elements or steps, unless such exclusion is explicitly stated. Furthermore, references to "one embodiment" of the present inventive subject matter are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

As used herein, the terms "system," "device," or "unit" may include a hardware and/or software system that operates to perform one or more functions. For example, a unit, device, or system may include a computer processor, controller, or other logic-based device that performs operations based on instructions stored on a tangible and non-transitory computer readable storage medium, such as a computer memory. Alternatively, a unit, device, or system may include a hard-wired device that performs operations based on hard-wired logic of the device. The units, devices, or systems shown in the attached figures may represent the hardware that operates based on software or hardwired instructions, the software that directs hardware to perform the operations, or a combination thereof. The systems, devices, or units can include or represent hardware circuits or circuitry that include and/or are connected with one or more processors, such as one or computer microprocessors.

One or more embodiments of the inventive subject matter described herein provide systems and methods for improved control of a vehicle system along a route. In various embodiments, an onboard system is provided that is configured to control movement of a vehicle system on a route relative to one or more vehicles ahead or behind along the same route and moving in the same, or opposite, direction or along a separate, intersecting route of the route that the vehicle system travels along. Alternatively, the onboard system controls movement of the vehicle system based on arrival time and/or departure time restrictions or location-based restrictions along the route that are imposed by a remote source, such as a dispatcher or an arrival or departure facility. For example, the onboard system paces the vehicle system such that the vehicle system does not travel too close to a vehicle ahead which would require the vehicle system or the vehicle behind to stop or at least slow considerably to increase the distance between the vehicles. The onboard system may also control the movement of the vehicle system relative to a vehicle behind the vehicle system, such as by maintaining a certain distance ahead of the vehicle behind to prohibit the trailing vehicle from being forced to slow to increase the distance between the vehicle system and the trailing vehicle. The trailing or leading vehicles can refer to actual (e.g., physical) vehicles or virtual vehicles whose behavior is designed to control an actual subject vehicle. For example, virtual vehicles may be used to facilitate an efficient meet/pass situation or to provide efficient interactions with non-vehicle systems (e.g., wayside/signaling devices or other vehicles/systems which are not physically traveling on the route as in the case of a cargo ship or mine loading system).

In the embodiments described herein, the onboard system controls the movement of the vehicle system along the route according to a trip plan that is generated by an energy management system (EMS). The EMS gathers information about a trip and the vehicle system, such as departure and destination locations, prescribed travel time, route details (speed limits, grade, curvature, etc.) and vehicle system makeup (number and types of vehicles, vehicle weights, etc.). The EMS generates a trip plan based on the gathered information. The trip plan describes a plan for driving the vehicle system that may satisfy and/or improve one or many objectives (e.g., fuel consumption, trip time, vehicle system handling, etc.) during the trip. The objectives may be considered "improved" relative to controlling the vehicle system along the same trip without implementing the trip plan, such as by manual control of an operator. The EMS may be disposed onboard the vehicle system or may be located remote from the vehicle system and communicatively connected to the vehicle system to provide the trip plan to the vehicle system. The EMS generates the trip plan for the vehicle system based on an awareness of planned or actual movements of at least a second vehicle on the route. The trip plan accounts for the movement of the second vehicle, such that the vehicle system implementing the trip plan along the route may maintain a distance from the second vehicle that allows the vehicle system to avoid mandated stops caused by proximity to the second vehicle.

In one or more embodiments described herein, the EMS incorporates the ability to control the vehicle system to move according to a given pacing speed (or pacing speed profile), which can considerably expand the utility of the EMS. For example, in a rail vehicle scenario in which a trailing train is following a slower, leading train, if the EMS on the trailing train has information about the leading train, the EMS is able to generate a speed profile that ensures at least a designated separation from the leading train while still improving the objectives of the trip, including travel time, fuel consumption, and/or the like. The information received by the EMS may be, for example, a speed profile implemented by the leading train along the route, a nominal average speed of the leading train, or the like. Avoiding unplanned stops and re-starts can result in improvements in one or more of the objectives of interest, such as reduced travel time, improved fuel economy, satisfaction of a prescribed arrival time, and the like.

One or more embodiment disclosed herein describe an EMS that generates a trip plan for controlling movement of a vehicle system, where the trip plan is generated based on a pacing speed, an arrival time, a minimum speed limit, and/or other constraints in order to pace the vehicle system along the route to ensure separation from other vehicles along the route. The pacing speed, for example, may be a constant speed or a speed profile in which the pacing speed changes with distance and/or time along the route based on route speed limits, route characteristics such as grade, power capabilities of one or more of the vehicle systems on the route, and the like. For a segment of the route in which pacing speed is to be enforced, configurable inputs can be provided.

At least one technical effect of such pacing provided by the generated trip plan is an increased overall throughput and efficiency along a network of routes as the trailing vehicle system is able to travel closer to a leading vehicle system than if the trailing vehicle system is controlled according to conventional methods, such as by relying on block signals. Furthermore, such pacing increases the overall throughput and efficiency by avoiding the mandated stops and ensuing delays that occur as a result of the trailing vehicle system traveling too close to the leading vehicle system. Avoiding the mandated stops also provides efficiency by allowing the trailing vehicle system to run slower than the vehicle system otherwise would travel along the route, thereby using less fuel and arriving at the destination at the same time as if the trailing vehicle system travelled faster and then had to stop and wait for the leading train. Another technical effect is to retain flexibility to allow the EMS to satisfy and/or improve one or many objectives of the trip (e.g., fuel consumption, trip time, vehicle system handling, etc.) in addition to controlling the vehicle system relative to a given pacing speed. Thus, the generated trip plan may deviate from the given pacing speed, within set limits, to allow the EMS to improve fuel economy, for example.

The various embodiments are described in more detail herein with reference to the accompanying figures.

FIG. 1 illustrates one embodiment of a vehicle system 102. The illustrated vehicle system 102 includes propulsion-generating vehicles 106 (e.g., vehicles 106A, 106B, 106C) and non-propulsion-generating vehicles 108 (e.g., vehicles 108A, 108B) that travel together along a route 110. Although the vehicles 106, 108 are shown as being mechanically coupled with each other, the vehicles 106, 108 alternatively may not be mechanically coupled with each other. For example, at least some of the vehicles 106, 108 may not be mechanically coupled to each other, but are still operatively coupled to each other such that the vehicles 106, 108 travel together along the route 110 via a communication link or the like. The number and arrangement of the vehicles 106, 108 in the vehicle system 102 are provided as one example and are not intended as limitations on all embodiments of the subject matter described herein. For example, the vehicle system 102 includes at least one propulsion-generating vehicle 106 and optionally may not include any non-propulsion-generating vehicles 108 such that the simplest vehicle system 102 is a single propulsion-generating vehicle 106. In the illustrated embodiment, the vehicle system 102 is shown as a rail vehicle system (e.g., train) such that the propulsion-generating vehicles 106 are locomotives and the non-propulsion-generating vehicles 108 are rail cars. But, in other embodiments, the vehicle system 102 may be an aircraft, a water vessel, an automobile, or an off-highway vehicle (e.g., a vehicle system that is not legally permitted and/or designed for travel on public roadways).

Optionally, groups of one or more adjacent or neighboring propulsion-generating vehicles 106 may be referred to as a vehicle consist. For example the vehicles 106A, 106B may be referred to as a first vehicle consist of the vehicle system 102, and the vehicle 106C may be referred to as a second vehicle consist of the vehicle system 102. The propulsion-generating vehicles 106 may be arranged in a distributed power (DP) arrangement. For example, the propulsion-generating vehicles 106 can include a lead vehicle 106A that issues command messages to the other propulsion-generating vehicles 106B, 106C, which are referred to herein as remote vehicles. The designations "lead" and "remote" are not intended to denote spatial locations of the propulsion-generating vehicles 106 in the vehicle system 102, but instead are used to indicate which propulsion-generating vehicle 106 is communicating (e.g., transmitting, broadcasting, or a combination of transmitting and broadcasting) command messages and which propulsion-generating vehicles 106 are receiving the command messages and being remotely controlled using the command messages. For example, the lead vehicle 106A may or may not be disposed at the front end of the vehicle system 102 (e.g., along a direction of travel of the vehicle system 102). Additionally, the remote vehicles 106B, 106C need not be separated from the lead vehicle 106A. For example, a remote vehicle 106B, 106C may be directly coupled with the lead vehicle 106A or may be separated from the lead vehicle 106A by one or more other remote vehicles 106B, 106C and/or non-propulsion-generating vehicles 108.

Figure 2:
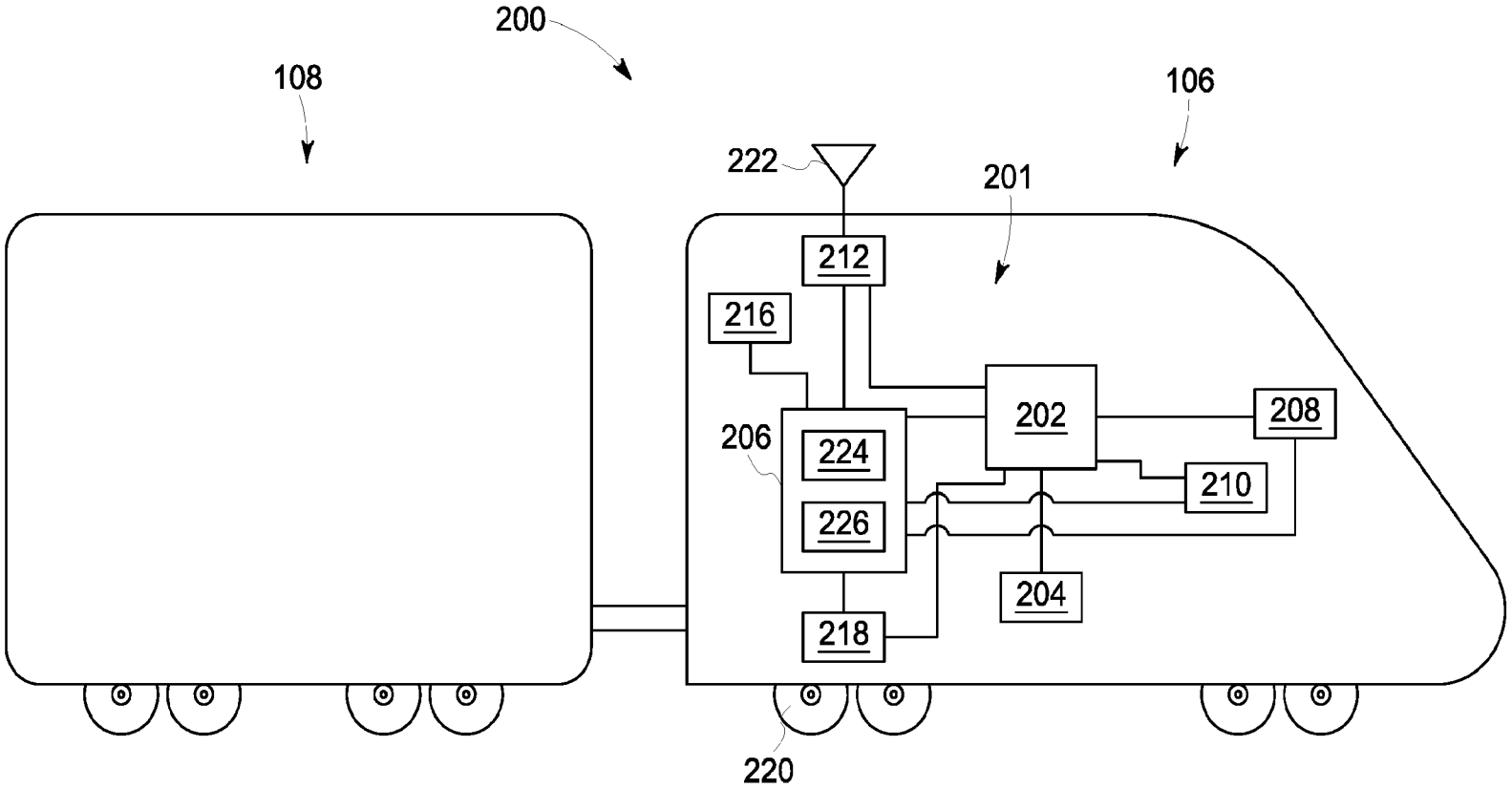
FIG. 2 is a schematic diagram of a vehicle system according to an embodiment.

FIG. 2 is a schematic diagram of a vehicle control system 201 associated with a vehicle system 200 according to an embodiment. The vehicle system 200 may be similar to the vehicle system 102 shown in FIG. 1. For example, the vehicle system 200 includes one propulsion-generating vehicle 106 and one non-propulsion-generating vehicle 108. The vehicle control system 201 in the illustrated embodiment includes a vehicle controller 202, a propulsion system 204, an energy management system (EMS) 206, a display device 208, a manual input device 210, a communication circuit 212, a locator device 216, and speed sensor 218. The vehicle control system 201 may include additional components, fewer components, and/or different components than the illustrated components in other embodiments. Although all of the components of the vehicle control system 201 in the illustrated embodiment are located on the same vehicle 106 of the vehicle system 200, optionally at least some of the components are disposed on the non-propulsion-generating vehicle 108. In an alternative embodiment, the EMS 206 of the vehicle control system 206 may be located remote from the vehicle system 200, such as on a wayside device or at a dispatch location, instead of onboard the vehicle system 200. In such an embodiment, the EMS 206 may communicate with the vehicle system 200 via the communication circuit 212 which is disposed onboard the vehicle system 200.

The vehicle controller 202 controls various operations of the vehicle system 200. The controller 202 may include or represent one or more hardware circuits or circuitry that include and/or are connected with one or more processors, controllers, or other hardware logic-based devices. For example, the controller 202 in an embodiment has one or more processors. The controller 202 is operatively connected with the propulsion system 204 in order to control the propulsion system 204. The propulsion system 204 may provide both propelling efforts and braking efforts for the vehicle system 200. The controller 202 may be configured to generate control signals autonomously or based on manual input that is used to direct operations of the propulsion system 204, such as to control a speed of the vehicle system 200. The vehicle controller 202 optionally may also control auxiliary loads of the vehicle system 200, such as heating, ventilation, and air-conditioning (HVAC) systems, lighting systems, and the like.

The propulsion system 204 includes propulsion-generating components, such as motors, engines, generators, alternators, turbochargers, pumps, batteries, turbines, radiators, and/or the like, that operate to provide power generation under the control implemented by the controller 202. The propulsion system 204 provides tractive effort to power wheels 220 of the vehicle system 200 to move the vehicle system 200 along the route. In another embodiment, the propulsion system 204 may include tracks that engage the route instead of the wheels 220 shown in FIG. 2. In a marine vessel embodiment, the propulsion system 204 may include one or more propellers instead of the wheels 220 to propel the vehicle system 200 through the water. The propulsion system 204 also includes brakes and affiliated components that are used to slow the vehicle system 200.

The speed sensor 218 is configured to monitor a speed of the vehicle system 200 along the route. The speed sensor 218 may monitor the speed by measuring the movement of one or more components, such as the rotational speed of one of the wheels 220 that engage the route, the rotational speed of a drive shaft (not shown), or the like. The speed sensor 218 is communicatively connected to the vehicle controller 202 and/or the EMS 206 to communicate speed measurement signals for analysis. Although only the speed sensor 218 is shown in FIG. 2, the vehicle system 200 may include additional sensors (not shown), such as additional speed sensors, pressure sensors, temperature sensors, position sensors, gas and fuel sensors, acceleration sensors, and/or the like. The sensors are configured to acquire operating parameters of various components of the vehicle system 200 and communicate data measurement signals of the operating parameters to the vehicle controller 202 and/or the EMS 206 for analysis.

The display device 208 is configured to be viewable by an operator of the vehicle system 200, such as a conductor or engineer. The display device 208 includes a display screen, which may be a liquid crystal display (LCD), a light emitting diode (LED) display, an organic light emitting diode (OLED) display, a plasma display, a cathode ray tube (CRT) display, and/or the like. The display device 208 is communicatively connected to the vehicle controller 202 and/or the EMS 206. For example, the vehicle controller 202 and/or the EMS 206 can present information to the operator via the display device 208, such as status information, operating parameters, a map of the surrounding environment and/or upcoming segments of the route, notifications regarding speed limits, work zones, and/or slow orders, and the like.

The manual input device 210 is configured to obtain operator input information from the operator of the vehicle system 200, and to convey the input information to the vehicle controller 202 and/or the EMS 206. The operator input information may be an operator-provided selection, such as a selection to limit the throttle settings of the vehicle system 200 along a segment of the route due to a received slow order, for example. The operator-provided selection may also include a selection to control the communication circuit 212 to communicate a message remotely to another vehicle, to a dispatch location, or the like or to actuate the brakes to slow and/or stop the vehicle system 200. The manual input device 210 may be a keyboard, a touchscreen, an electronic mouse, a microphone, a wearable device, or the like. Optionally, the manual input device 210 may be housed with the display device 208 in the same case or housing. For example, the input device 210 may interact with a graphical user interface (GUI) generated by the vehicle controller 202 and/or the EMS 206 and shown on the display device 208.

The communication circuit 212 is operably connected to the vehicle controller 202 and/or the EMS 206. The communication circuit 212 may represent hardware and/or software that is used to communicate with other devices and/or systems, such as remote vehicles or dispatch stations. The communication circuit 212 may include a transceiver and associated circuitry (e.g., an antenna 222) for wireless bi-directional communication of various types of messages, such as linking messages, command messages, reply messages, status messages, and/or the like. The communication circuit 212 may be configured to transmit messages to specific designated receivers and/or to broadcast messages indiscriminately. Optionally, the communication circuit 212 also includes circuitry for communicating messages over a wired connection, such as an electric multiple unit (eMU) line (not shown) between vehicles of a vehicle system 200, a catenary line or conductive rail of a track, or the like.

The locator device 216 is configured to determine a location of the vehicle system 200 along the route. The locator device 216 may be a GPS receiver or a system of sensors that determine a location of the vehicle system 200. Examples of such other systems include, but are not limited to, wayside devices, such as radio frequency automatic equipment identification (RF AEI) tags and/or video-based determinations. Another system may use a tachometer and/or speedometer aboard the propulsion-generating vehicle 106 and distance calculations from a reference point to calculate a current location of the vehicle system 200. The locator device 216 may be used to determine the proximity of the vehicle system 200 along the route from one or more blocks or block signals, from one or more other vehicles on the route, from a work zone or another speed-restricted zone, from a quiet zone, or the like.

The EMS 206 of the vehicle system 200 is configured to receive, generate, and/or implement a trip plan that controls movements of the vehicle system 200 along the route to improve one or more operating conditions and/or satisfy one or more objectives while abiding by various constraints. The EMS 206 includes one or more processors 224, such as a computer processor or other logic-based device that performs operations based on one or more sets of instructions (e.g., software). The instructions on which the EMS 206 operates may be stored on a tangible and non-transitory (e.g., not a transient signal) computer readable storage medium, such as a memory 226. The memory 226 may include one or more computer hard drives, flash drives, RAM, ROM, EEPROM, and the like. Alternatively, one or more of the sets of instructions that direct operations of the EMS 206 may be hard-wired into the logic of the EMS 206, such as by being hard-wired logic formed in the hardware of the EMS 206.

The EMS 206 may receive a schedule from an off-board scheduling system. The EMS 206 may be operatively (e.g., communicatively) connected with the communication circuit 212 to receive an initial and/or modified schedule send from the scheduling system. In an embodiment, the schedules are conveyed to the EMS 206, and may be stored in the memory 226. Alternatively, the schedule may be recorded in the memory 226 of the EMS 206 via a hard-wired connection, such as before the vehicle system 200 starts on a trip along the route. The schedule may include information about the trip, such as the route to use, the departing and destination locations, the desired total time of travel, the desired arrival time at the destination location, desired arrival times at various checkpoint locations along the route, the location and time of any meet and pass events along the route, and/or the like.

In an embodiment, the EMS 206 (including the processors 224 thereof) generates a trip plan based on the schedule. The trip plan may designate throttle settings, brake settings, speeds, or the like, of the vehicle system 200 for various segments of the route during the scheduled trip of the vehicle system 300 to the scheduled destination location. The trip plan may be generated to reduce the amount of fuel that is consumed by the vehicle system 200 and/or the amount of emissions generated to improve one or more operating parameters or objectives of the vehicle system 200 as the vehicle system 200 moves during the trip relative to the vehicle system 200 traveling along the trip without following the trip plan. For example, the objectives may be to reduce fuel consumption and emissions generation. The trip plan may be generated such that controlling the vehicle system 200 according to the trip plan may result in the vehicle system 200 consuming less fuel and/or generating fewer emissions to reach a destination location than if the same vehicle system 200 traveled along the same route to arrive at the same destination location at the same time as the trip plan by following the set speed limits of the route. Other objectives may include reducing a travel time of the trip from the departure location to the destination location, improving handling, reducing noise emissions, reducing vehicle wear, arriving to the destination at by a prescribed time, and the like. The trip plan may be generated to abide by set constraints, such as speed limits, regulatory restrictions (e.g., noise, emissions, etc.), and the like.

In order to generate the trip plan for the vehicle system 200, the EMS 206 can refer to a trip profile that includes information related to the vehicle system 200, information related to a route over which the vehicle system 200 travels to arrive at the scheduled destination, and/or other information related to travel of the vehicle system 200 to the scheduled destination location at the scheduled arrival time. The information related to the vehicle system 200 may include information regarding the fuel efficiency of the vehicle system 200 (e.g., how much fuel is consumed by the vehicle system 200 to traverse different sections of a route), the tractive power (e.g., horsepower) of the vehicle system 200, the weight or mass of the vehicle system 200 and/or cargo, the length and/or other size of the vehicle system 200, the location of powered units in the vehicle system 200, and/or other information. The information related to the route to be traversed by the vehicle system 200 can include the shape (e.g., curvature), incline, decline, and the like, of various sections of the route, the existence and/or location of known slow orders or damaged sections of the route, and the like. Other information can include information that impacts the fuel efficiency of the vehicle system 200, such as atmospheric pressure, temperature, precipitation, and the like. The trip profile may be stored in the memory 226 of the EMS 206.

The trip plan is formulated by the EMS 206 (e.g., by the one or more processors 224) based on the trip profile and the schedule (which may be combined with one another). The tractive and braking operations dictated by the trip plan may be specific to different locations and/or times along the route. For example, if the trip profile requires the vehicle system 200 to traverse a steep incline, then the EMS 206 may generate a trip plan that dictates the propulsion system 204 to provide increased tractive efforts along that segment of the trip. If a subsequent segment of the route has a downhill or decline grade, the trip plan of the EMS 206 may dictate decreased tractive efforts by the propulsion system 204 for the subsequent segment of the trip. Thus, the trip plan may control the vehicle system 200 to provide different tractive and braking efforts as the vehicle system 200 travels along different segments of the route. In an embodiment, the EMS 206 includes a software application or system such as the Trip Optimizer™ system provided by General Electric Company. The EMS 206 may directly control the propulsion system 204, may indirectly control the propulsion system 204 by providing control messages or signals to the vehicle controller 202, and/or may provide prompts to an operator for guided manual control of the propulsion system 204.

In one embodiment, the processor(s) 224 and the memory 226 are housed within a common hardware housing or case. In an alternative embodiment, however, the processor(s) 224 and the memory 226 are disposed in separate housings or cases from one another. As described above, in another alternative embodiment, the EMS 206 may be located remote from the vehicle system 200.

In various embodiments described below, the EMS 206 generates the trip plan that dictates a plan speed profile for the vehicle system 200. The plan speed profile provides designated speeds for the vehicle system 200 based on location and/or time along the route according to the trip plan. For example, the plan speed profile may prescribe the vehicle system 200 to travel at 50 miles per hour (mph) through an upcoming block of the route, and then to slow to 35 mph upon traversing a steep incline in the route in order to conserve fuel.

In one or more embodiments, the plan speed profile (of the trip plan) may be generated based in part on a designated pacing speed profile or one or more intermediate arrival constraints (e.g., arrive at a designated location before, after, at, or within a designated time frame relative to a given time) in order to pace the vehicle system 200 relative to one or more other vehicle systems in the route network. The pacing speed profile is used by the EMS 206 in the calculation of the trip plan (and plan speed profile) as one or more constraints. For example, the pacing speed profile may be used to provide one or more soft constraints which, if exceeded, are penalized during the calculation or analysis. For example, a soft constraint is a constraint whose violations are incorporated into an objective function when generating the trip plan. The soft constraint is allowed to be violated if necessary, but violations of the soft constraint are configured to be reduced. Thus, the generated trip plan will have a plan speed profile that is based in part on the soft constraints derived from the pacing speed profile.

In one embodiment referred to as a virtual vehicle approach, the pacing speed profile is associated with a virtual vehicle, and the trip plan maintains the plan speed profile of the vehicle system 200 within a designated range of the pacing speed profile of the virtual vehicle such that the boundaries of the designated range are soft constraints in the analysis. A virtual vehicle may represent an intangible representation of a vehicle, and not an actual, tangible vehicle moving along the route. Pacing of an actual, tangible vehicle system may be controlled to maintain a separation distance from the movement of the virtual, intangible vehicle. In another embodiment referred to as an average speed approach, the trip is segmented based on distance or time, and the trip plan is generated with a soft constraint that the average speed of the plan speed profile of the vehicle system 200 matches the average speed of the plan speed profile at the start (or end) of each segment of the trip. In yet another embodiment that is referred to as a speed difference approach, the trip plan is generated to reduce the difference between the pacing speed profile and the plan speed profile at various points during the trip.

Figure 3:
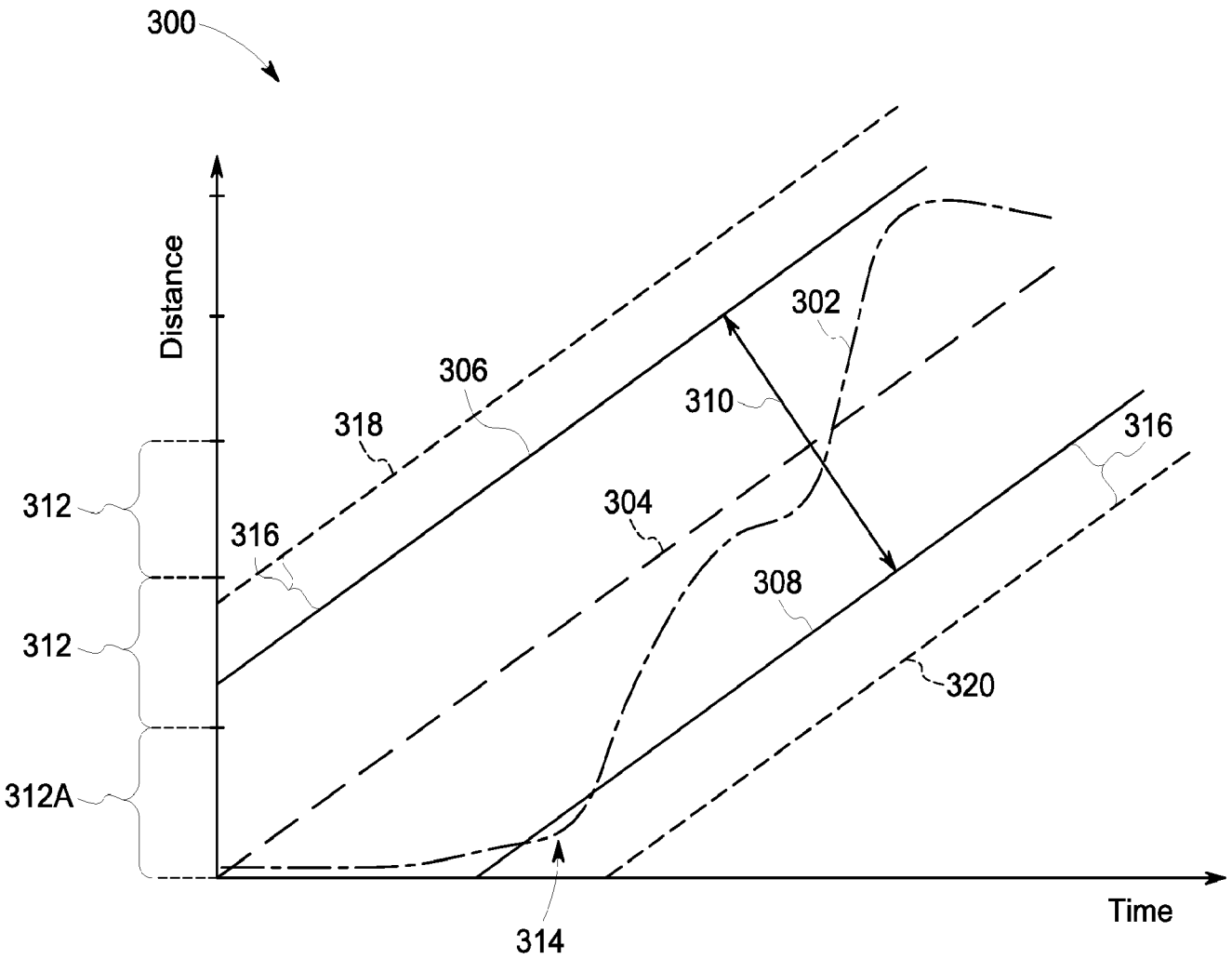
FIG. 3 is a graph plotting movement of a vehicle system according to a plan speed profile relative to movement of a virtual vehicle according to a pacing speed profile in accordance with an embodiment.

FIG. 3 is a graph 300 plotting movement of a vehicle system according to a plan speed profile 302 relative to movement of a virtual vehicle according to a pacing speed profile 304. The graph 300 illustrates the virtual vehicle approach of administering soft constraints to generate a trip plan with a plan speed profile that paces a vehicle system during a trip.

The virtual vehicle may be hypothetically assumed to start a trip, or a segment of a trip, along a route simultaneously with an actual vehicle system (e.g., the vehicle system 200 shown in FIG. 2) that travels along the route. For example, the virtual vehicle approach may be used to generate the plan speed profile 302 for an entire trip of a vehicle system or for one or more specific segments of the trip in which the vehicle system should be paced relative to one or more other vehicles on the route. The virtual vehicle is a computer-generated model that is used to generate the plan speed profile 302 of the vehicle system. The virtual train is assumed to operate according to the pacing speed profile 304. As stated above, the pacing speed profile 304 may be related to the movements of another vehicle system on the route. For example, the pacing speed profile 304 may be derived from a trip plan that is being followed by a leading vehicle system in front of the vehicle system 200 or a trailing vehicle system behind the vehicle system 200. The pacing speed profile 304 may be derived from known locations and/or movements of other vehicle systems, which may be communicatively received by the vehicle system 200 via operator input, remote messages from other vehicle systems, dispatchers, wayside devices, or the like. For example, a dispatcher may transmit the trip plan (or a speed profile thereof) of a leading vehicle system to a trailing vehicle system on the same route to allow the trailing vehicle system to generate a trip plan having a speed profile that paces the trailing vehicle system relative to the leading vehicle system.

In the illustrated embodiment, the pacing speed profile 304 is a constant speed (e.g., the slope of the plotline 304 representing distance over time of the virtual vehicle is constant). The pacing speed profile 304 may be an average speed of another vehicle system, such as a leading vehicle system ahead on the route. Alternatively, the pacing speed profile 304 may have varying speeds over distance and time. For example, the pacing speed profile 304 may be the actual speed profile being followed by a leading vehicle system on the route, such that the pacing speed profile 304 has varying speeds along the route according to route characteristics (e.g., grade, adhesion, etc.), weather, traffic, vehicle capabilities, and the like. Although the pacing speed profile 304 is described as being associated with a leading vehicle ahead of the vehicle system 200 (shown in FIG. 2), the pacing speed profile 304 additionally or alternatively may be associated with a vehicle system behind the vehicle system 200 along the route that is traveling in the same direction.

The plan speed profile 302 is generated to pace the vehicle system 200 relative to one or more vehicle systems by maintaining at least a designated separation distance between the vehicle systems to avoid the vehicle system 200 or a trailing vehicle system behind being forced to stop due to proximity to the vehicle system ahead. The vehicle system 200 is maintained at least a designated separation distance from one or more other vehicles because the plan speed profile 302 is generated to keep the movement (e.g., distance over time characteristics) of the vehicle system 200 relatively close to that of the virtual vehicle. The term "close" may be prescribed in terms of a separation distance, a separation time, or a combination. Thus, the vehicle system 200 is paced by moving generally within a designated movement window 310 or range of the virtual vehicle.

The pacing speed profile 304 is used to set constraints for the planning of the plan speed profile in order to generally maintain the vehicle system 200 within the designated movement window 310 of the virtual vehicle. Therefore, the pacing speed profile 304 may be a target trajectory that is used for pacing. In FIG. 3 the constraints are time-distance boundaries that surround the pacing speed profile. The boundaries include an upper time-distance boundary 306 and a lower time-distance boundary 308. The boundaries 306, 308 are based on the pacing speed profile 304. The time-distance boundaries 306, 308 in the illustrated embodiment are the same speed as the pacing speed profile 304, but are offset a designated distance and/or time from the pacing speed profile 304. The upper boundary 306 may be a designated positive offset (e.g., in distance at a given time) relative to the pacing speed profile 304, and the lower boundary 308 may be a designated negative offset relative to the pacing speed profile 304. The range of acceptable times and distances between the boundaries 306, 308 is referred to as a movement window 310. For example, the pacing speed profile 304 may have a constant speed of 50 mph, the upper boundary 306 may be set to five miles in front of the pacing speed profile 304, and the lower boundary 308 may be set to five miles behind the pacing speed profile 304. Thus, the movement window 310 may be within plus or minus five miles of the target trajectory. Optionally, the difference between the pacing speed profile 304 and the upper boundary 306 may not be equal to the difference between the pacing speed profile 304 and the lower boundary 308. For example, the upper boundary 306 may be set to 3 miles in front of the pacing speed profile 304, while the lower boundary 308 is set to 6 miles behind the pacing speed profile 304. Although the boundaries 306, 308 surrounding the pacing speed profile 304 are described as representing differences in distance, in other embodiments the boundaries 306, 308 may represent time instead of distance. For example, the movement window 310 between the boundaries 306, 308 may represent a times along the route that are before and after the virtual vehicle.

In an alternative embodiment, the upper time-distance boundary 306 and the lower time-distance boundary 308 may be based on different pacing speed profiles. For example, the upper boundary 306 may be a designated positive offset (e.g., in distance or time) relative to a first pacing speed profile, and the lower boundary 308 may be a designated negative offset (e.g., in distance or time) relative to a different, second pacing speed profile. The first and second pacing speed profiles may be based on the movement of different vehicles along the route, such that the first pacing speed profile is based on a leading vehicle system in front of the vehicle system 200 and the second pacing speed profile is based on a trailing vehicle system behind the vehicle system 200.

The time-distance boundaries 306, 308 are used as soft constraints in the trip planning analysis used to generate the plan speed profile 302. The trip plan is generated by the EMS 206 (shown in FIG. 2) such that the plan speed profile or trajectory 302 is restricted between the boundaries 306, 308. The EMS 206 retains an ability to generate a trip plan that will satisfy and/or improve upon one or many objectives (e.g., fuel consumption, trip time, arrival time, vehicle system handling, etc.) within the constraints imposed by the boundaries 306, 308. A technical effect of the EMS 206 is the determination of a plan speed profile that is compliant with the pacing speed trajectory (by staying generally within the boundaries 306, 308 of the pacing speed profile 304) and also has desirable performance with regard to other objectives. Since the boundaries 306, 308 may be soft constraints, if no potential speed profile is able to respect the physical constraints of the vehicle and the trip while satisfying the pacing constraint (e.g., staying within the movement window 310), small violations of the pacing constraint may be permitted until a feasible speed profile is obtained. As used herein, the vehicle system 200 is "generally maintained" to move within the movement window because the boundaries 306, 308 are used as soft constraints that are allowed to be violated if necessary. In an alternative embodiment, the time-distance boundaries 306, 308 may be used as hard constraints when generating the trip plan, such that the time-distance boundaries 306, 308 are not able to be violated.

The size of the movement window 310 is relative to the pacing speed profile 304, and may have any reasonable time-distance magnitude. For example, the movement window 310 could be a range of distances within 10 miles in front of and/or behind the pacing speed profile 304. The movement window 310 may vary throughout the trip as a function of the block length. For example, the length of the movement window 310 may vary with distance as the block lengths change. The length of the movement window 310 may also be based on vehicle characteristics, such as vehicle system length, vehicle speed, vehicle system type (e.g., a hazardous vehicle ahead of the vehicle system may require the virtual vehicle to have a longer movement window 310 than a non-hazardous vehicle ahead of the vehicle system), and the like. The size of the movement window 310 may be designated based on a tradeoff between network throughput and fuel savings. For example, a larger movement window 310 (with wider boundaries 306, 308) allows the EMS 206 more freedom in generating the trip plan such that the plan speed profile may provide improved satisfaction of the trip objectives, including fuel economy, compared to a narrower movement window 310. However, a large movement window 310 allows larger variations in movement characteristics, such as slower speeds, than a narrower movement window 310, which may result in a reduced network throughput or density of vehicles along the routes in the network.

In an embodiment, the trip may be partitioned into multiple segments 312. In the illustrated embodiment, the segments 312 are lengths along the route. The time-distance boundaries 306, 308 are soft constraints, and violations of the boundaries 306, 308 are penalized as the trip plan is generated. Since the trip is segmented, a violation along one segment 312 does not affect other segments 312. The trip plan may be generated as a cost function that is intended to be minimized, so a violation of one of the boundaries 306, 308 results in an added weight to the cost function. In the illustrated embodiment, the plan speed profile 302 violates the lower time-distance boundary 308 at a violation location 314 in the first segment 312A when the distance of the vehicle according to the plan speed profile 302 behind the virtual vehicle traveling according to the pacing speed profile 304 exceeds the distance between the pacing speed profile 304 and the lower time-distance boundary 308. The plan speed profile 302 in FIG. 3 does not violate either of the boundaries 306, 308 along any other segments 312 of the trip.

The graph 300 may also designate time-distance buffer zones 316 outside of the boundaries 306, 308. The buffer zones 316 are safety margins between the boundaries 306, 308 and respective upper and lower buffer limits 318, 320. The buffer limits 318, 320 are hard boundaries, such that the plan speed profile 302 cannot exceed either of the buffer limits 318, 320. Movement of the vehicle system that would exceed the upper buffer limit 318 risks an accident with a vehicle system ahead on the route. Similarly, movement of the vehicle system that would exceed the lower buffer limit 320 risks an accident with a vehicle system behind on the route. Thus, the plan speed profile 302 may extend into the buffer zones 316, resulting in a penalty, but the plan speed profile 302 is not allowed to exceed either of the buffer limits 318, 320.

Figure 4:
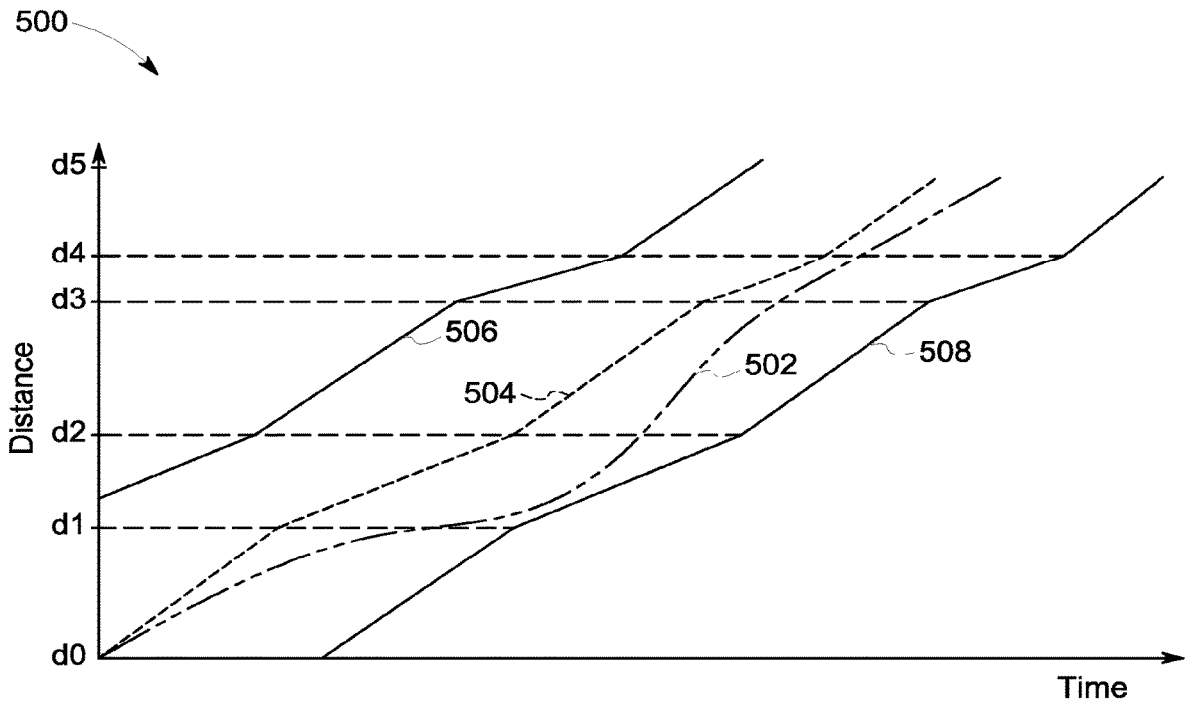
FIG. 4 is a graph plotting movement of a vehicle system according to a plan speed profile relative to movement of a virtual vehicle according to a pacing speed profile in accordance with another embodiment.

FIG. 4 is a graph 500 plotting movement of a vehicle system according to a plan speed profile 502 relative to movement of a virtual vehicle according to a pacing speed profile 504. The graph 500 shows planned movement of a vehicle system according to distance over time along a trip. In an embodiment, the pacing speed profile 504 may vary along the distance and time of the trip instead of being a single constant speed (as shown in FIG. 3). For example, the pacing speed profile 504 may change based on changing permanent speed limits, varying planned movement of a vehicle ahead or behind on the route, temporary speed limits (e.g., due to work zones), and the like. In the illustrated embodiment, the pacing speed profile 504 has a first speed between locations d0 and d1 along the route, a second speed between locations d1 and d2, a third speed between locations d2 and d3, a fourth speed between locations d3 and d4, and a fifth speed between locations d4 and d5. At least some of the five speeds may be the same. An upper time-distance boundary 506 may vary along the trip according to the varying pacing speed profile 504 such that the upper boundary 506 maintains a generally constant time and/or distance gap relative to the pacing speed profile 504. Similarly, a lower time-distance boundary 508 may vary along the trip according to the pacing speed profile 504 such that the lower boundary 508 maintains a generally constant time and/or distance gap relative to the pacing speed profile 504. Alternatively, the upper and/or lower time-distance boundary 506, 508 do not maintain generally constant time and/or distance gaps relative to the pacing speed profile 504 due to various reasons. For example, it might be desirable to reduce the respective gaps near sidings or crossings. Furthermore, the respective gap between the lower boundary 508 and the pacing speed profile 504 would vary if the lower boundary 508 is generated based on a different pacing speed profile than the pacing speed profile 504. The plan speed profile 502 is generated based on the upper and lower time-distance boundaries 506, 508 such that the boundaries 506, 508 are used as soft constraints to maintain the plan speed profile 502 generally within a movement window 510 defined between the boundaries 506, 508.

Figure 5:
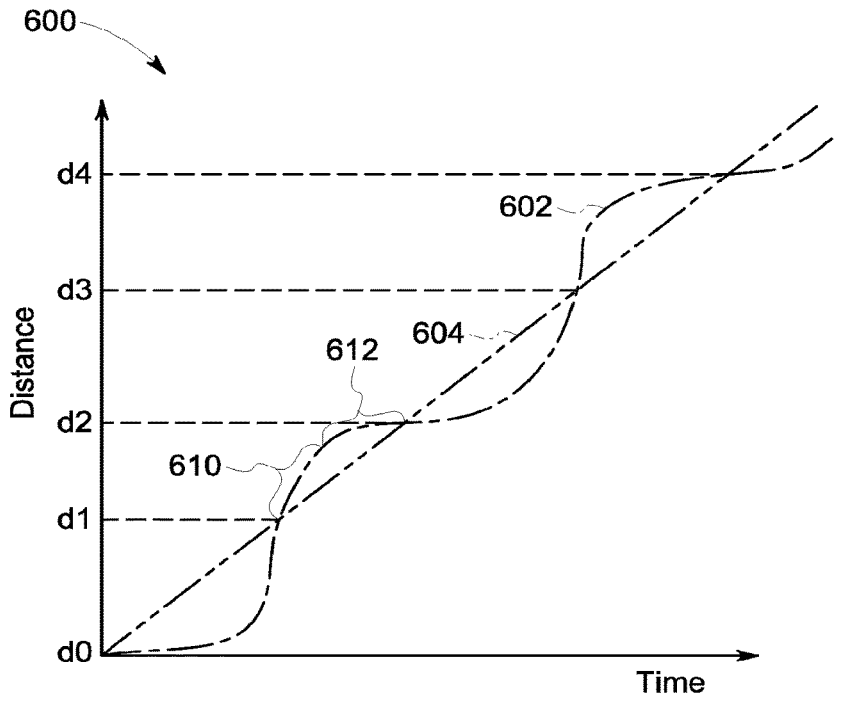
FIG. 5 is a graph plotting movement of a vehicle system according to a plan speed profile relative to movement of a virtual vehicle according to a pacing speed profile in accordance with another embodiment.

FIG. 5 is a graph 600 plotting movement of a vehicle system according to a plan speed profile 602 relative to movement of a virtual vehicle according to a pacing speed profile 604. The graph 600 illustrates the average speed approach of administering soft constraints to generate a trip plan with a plan speed profile that paces a vehicle system during a trip. In the average speed approach, the trip is segmented based on distance or time, and the trip plan is generated with a soft constraint that the average speed of the plan speed profile 602 of a vehicle system (e.g., the vehicle system 200 shown in FIG. 2) matches the average speed of the plan speed profile 604 at the start (or end) of each segment of the trip.

The trip may be segmented into distance segments along the route or time segments during movement of the vehicle system along the route. The length of the segments may be determined before a trip or "on-the-fly" at the time when the EMS 206 is computing the plan speed profile 602. In the illustrated embodiment, the segments are distances, and the trip is segmented into a first length between locations d0 and d1, a second length between locations d1 and d2, a third length between locations d2 and d3, and a fourth length between locations d3 and d4. The locations d1, d2, d3, and d4 may be selected based on route characteristics, such as the locations of boundaries between adjacent blocks, hills and other grade changes, sidings (for meet and pass events), track signals, or the like. The four lengths need not represent equal distances. The trip may be divided into any number of segments.

According to the average speed approach, the average speed of the pacing speed profile 604 is a soft constraint in the generation of the plan speed profile 602. The plan speed profile 602 is generated to control the average speed of the vehicle system along the route. For example, the plan speed profile 602 is computed such that the profile 602 intersects the pacing speed profile 604 at each of the locations d1-d4 that define boundaries between the segments. Since graph 600 plots distance over time, the average speed of the plan speed profile 602 matches the average speed of the pacing speed profile 604 at the intersections, although the instantaneous speeds of the two profiles 602, 604 at the intersections need not be the same. As used herein, the average speed of the plan speed profile 602 may be considered to "match" the average speed of the pacing speed profile 604 if the average speeds are within a designated error range from one another, such as 1 mph, 2 mph, 1%, 2%, or the like. As shown in FIG. 5, for example, the instantaneous speed of the plan speed profile 602 is greater than the speed of the pacing speed profile 604 at a beginning portion 610 of the second length from location d1. The speed of the plan speed profile 602 thereafter decreases below the speed of the pacing speed profile 604 along an end portion 612 of the second length and intersects the pacing speed profile 604 at location d2. Thus, the average speed of the two speed profiles 602, 604 are equal at location d2 although the current speeds vary along the second length. Although the pacing speed profile 604 is shown as a single constant speed in FIG. 5, the spacing speed profile 604 may not be a single constant speed in other embodiments, such as the embodiment shown in FIG. 4.

The matching of the average speed of the plan speed profile 602 to the average speed of the pacing speed profile 604 at the boundary locations d1-d4 of the segments of the trip is a soft constraint. Thus, the plan speed profile 602 is generated with an objective to match the average speeds at the locations d1-d4, but the average speeds may not match at every boundary location d1-d4. In response to the average speed of the plan speed profile 602 not matching the average speed of the pacing speed profile 604 at a boundary location, the plan speed profile 602 is penalized based on the amount of deviation from the average speed of the pacing speed profile 604. Thus, the plan speed profile 602 is computed to reduce deviations between the average speeds of the two speed profiles 602, 604 at the boundary locations d1-d4. The soft constraint of matching the average speeds only applies at the boundary locations d1-d4, so the EMS 206 has the ability to control movement of the vehicle system to satisfy and/or improve the designated objectives of the trip (e.g., improving fuel economy, reducing travel time, etc.) along the route between each adjacent pair of the boundary locations d1-d4. Due to the EMS 206 attempting to satisfy and/or improve the designated trip objectives, the plan speed profile 602 follows a tortuous path relative to the pacing speed profile 604.

Figure 6:
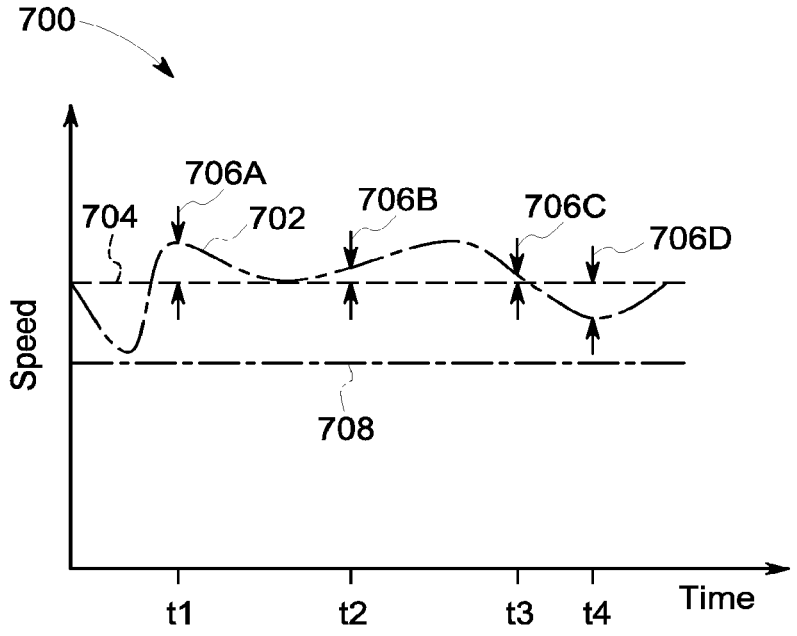
FIG. 6 is a graph plotting movement of a vehicle system according to a plan speed profile relative to movement of a virtual vehicle according to a pacing speed profile in accordance with another embodiment.

FIG. 6 is a graph 700 plotting movement of a vehicle system according to a plan speed profile 702 relative to movement of a virtual vehicle according to a pacing speed profile 704. The graph 700 illustrates the speed difference approach of administering soft constraints to generate a trip plan with a plan speed profile 702 that paces a vehicle system during a trip. In the speed difference approach, the trip plan is generated to reduce the difference in speeds between the pacing speed profile 704 and the plan speed profile 702 at various points during the trip. During the generation of the trip plan, the pacing speed is enforced by penalizing deviations of the instantaneous speed of the plan speed profile 702 from the instantaneous speed of the pacing speed profile 704. The speed difference between the two speed profiles 702, 704 may be penalized in one embodiment by penalizing the sum of the square of the difference in speeds. In another embodiment, the maximum magnitude value of the difference in speeds may be penalized. A greater speed difference is penalized to a greater extent than a smaller speed difference, although the smaller speed difference may also be penalized.

The graph 700 plots speeds of the pacing speed profile 704 and the plan speed profile 702 over time. The pacing speed profile 704 is illustrated as a constant speed, and the plan speed profile 702 follows a path that intersects the pacing speed profile 704 at multiple times during the trip. The plan speed profile 702 follows a path relative to the pacing speed profile 704, instead of following the same path as the pacing speed profile 704, to control movement of the vehicle system to satisfy and/or improve the designated objectives of the trip (e.g., improving fuel economy, reducing travel time, etc.). However, the plan speed profile 702 is restrained from deviating too much from the pacing speed profile 704 by the penalties imposed on the speed differences at various points along the trip. The points along the trip in which the speed difference approach is implemented may be periodic times (e.g., every minute, every two minutes, etc.), specific times based on locations along the route (e.g., the entrances and/or exits of block segments), or the like. In the illustrated embodiment, speed differences 706A, 706D between the speed of the plan speed profile 702 and the speed of the pacing speed profile 704 at times t1 and t4, respectively, are greater than the respective speed differences 706B, 706C at times t2 and t3. Thus, the plan speed profile 702 may be penalized at times t1 and t4 greater than at times t2 and t3. It is also recognized that the constraint functions may be different on the positive and negative sides of the pacing speed profile 704. For example, a positive difference between the speed of the plan speed profile 702 and the pacing speed profile 704 may be penalized differently than a negative difference of the same magnitude. As shown in FIG. 6, the speed of the plan speed profile 702 at time t1 is greater than the speed of the pacing speed profile 704, while the speed of the plan speed profile 702 at time t4 is less than the speed of the pacing speed profile 704. The speed difference 706A at time t1 optionally may be penalized differently than the speed difference 706D at time t4 although the magnitudes of the speed differences at times t1 and t4 are approximately the same.

In an embodiment, a speed difference between the pacing speed profile 704 and the plan speed profile 702 may not be enforced (e.g., penalized) during times in which the speeds of the pacing speed profile 704 are greater than an allowed speed of the vehicle system, such as a posted permanent speed limit, a slow order (i.e., a temporary speed limit), or the like.

Figure 7:
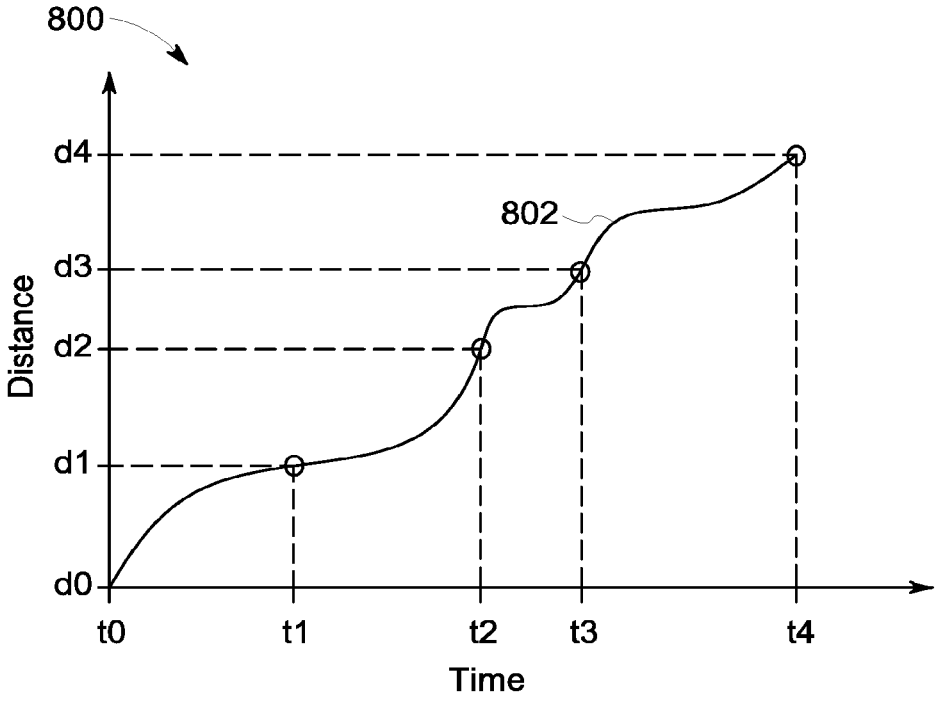
FIG. 7 is a graph plotting a plan speed profile for a trip of a vehicle system according to an embodiment.

FIG. 7 is a graph 800 plotting a plan speed profile 802 for a trip of a vehicle system according to an embodiment. The plan speed profile 802 may be generated by the EMS 206 (shown in FIG. 2) of the vehicle system 200 (FIG. 2) as a portion of a trip plan. The plan speed profile 802 is generated to control movement of the vehicle system on a trip to pace the vehicle system to ensure separation from other vehicles along the route. In the embodiment shown in FIG. 7, the EMS 206 generates the plan speed profile 802 using an arrival time approach in which multiple arrival times along the trip are used as soft constraints in the analysis. The multiple arrival times are used to pace the vehicle system along the route as the plan speed profile 802 is generated to control the vehicle system to arrive at designated locations at respective arrival times. These designations may, for example, represent meet/pass activities which have been scheduled by a dispatcher or automated dispatch system. As used herein, arriving at a designated location at a respective arrival time may include arriving before the arrival time, arriving at the arrival time, arriving after the arrival time, or arriving within a designated time frame, range, or window relative to the arrival time, such as a two minute window that extends from one minute before the arrival time to one minute after the arrival time.

In the arrival time approach, the trip is segmented into multiple lengths, and an arrival time at the end of each length is designated. The designated arrival time for the end of the last length in the trip is the destination arrival time, which may be designated in the trip schedule. The number of lengths into which the trip is segmented, the specific end locations of the lengths, and the arrival times for the end locations may be specified remotely from the EMS 206. For example, the arrival times, end locations, and number of lengths may be designated by a dispatcher at a remote dispatch location, another vehicle system on the route (e.g., a vehicle system ahead or behind the vehicle system that is to follow the plan speed profile), an operator that manually controls the vehicle system, or the like. For example, the arrival time information may be received in a message format by the communication circuit 212 of the vehicle system 200, or may be input by the operator using the manual input device 210 of the vehicle system 200.

The plan speed profile 802 in the graph 800 is plotted according to distance along the route over time. In the illustrated embodiment, the trip is segmented into a first length between locations d0 (e.g., the starting location) and d1, a second length between locations d1 and d2, a third length between locations d2 and d3, and fourth length between locations d3 and d4 (e.g., the destination location). The lengths are defined by the end locations d1, d2, d3, and d4 thereof. The intermediate end locations d1-d3 along the route between the starting location and the destination location may be selected based on route characteristics. The route characteristics may be traffic or block signals, block segments, meet and pass locations, siding locations, stations, wayside devices, or the like. A respective arrival time is designated for each intermediate end location d1-d3. Each respective arrival time represents a time or time range in which a portion of the vehicle system should cross the designated end location. The portion of the vehicle system used to determine when the vehicle system crosses the designated end location may be a head or front end of the vehicle system, a tail or rear end of the vehicle system, or another location along the vehicle system between the front and rear ends. The vehicle system may be considered to satisfy a respective arrival time constraint responsive to the portion of the vehicle system arriving at a designated end location d1-d4 before the arrival time or within a range of the arrival time. The range may be a period of time before the arrival time that ends at the arrival time or may extend beyond the arrival time. For example, the range may be 1 minute, 2, minutes, 4 minutes, or the like. Since the arrival times are used as soft constraints, arrival times that are not satisfied are penalized during the computation of the plan speed profile 802. The amount or severity of the penalty may depend on the time difference between the actual arrival time according to the plan speed profile and the designated arrival time.

As shown in the graph 800, each of the end locations d1-d4 has an associated arrival time t1-t4. The arrival time t4 is the destination arrival time at the destination location d4. The plan speed profile 802 is generated to control the movement of the vehicle system along the trip such that the vehicle system arrives at the end locations d1-d4 at times that satisfy the designated arrival times t1-t4. The movement of the vehicle system between each pair of adjacent locations d0-d4 may be controlled in order to satisfy and/or improve one or many objectives (e.g., fuel consumption, trip time, vehicle system handling, etc.) during the trip. Thus, as shown in FIG. 7, the plan speed profile 802 does not need to have a constant speed along each partitioned length of the trip, but rather follows a varying speed path. Although the plan speed profile 802 follows a non-linear path, the plan speed profile 802 crosses the end locations d1-d4 at the respective designated arrival times t1-t4, which paces the vehicle system along the route.

The arrival time approach of generating a trip plan with a plan speed profile that paces a vehicle system along a trip does not account for speeds of the vehicle system. Thus, the plan speed profile 802 is not constrained in terms of speed beyond those imposed by the route itself (e.g., speed limits). Optionally, the arrival time approach may be combined with the pacing speed approach when generating the plan speed profile. In the arrival time approach, the number of partitions of the trip and, therefore, the number of designated arrival time constraints, affects the flexibility of the EMS 206 to generate a plan speed profile to satisfy or improve trip objectives, such as reducing fuel consumption. For example, by adding more arrival time constraints, the EMS 206 is more limited in the ability to reduce fuel consumption since the vehicle system has more arrival times to satisfy along the trip. Furthermore, although the arrival time approach may be combined with the pacing speed approach or other approaches described herein, there may be less of an incentive to combine with other constraint-approaches if many arrival times constraints are employed.

In another approach, a plan speed profile is generated to pace a vehicle system along a trip while additionally enforcing a minimum speed. The minimum speed approach designates a minimum speed that is used as a soft constraint in the generation of the plan speed profile. The plan speed profile is generated such that the vehicle system following the plan speed profile is maintained at speeds at and/or above the designated minimum speed along the trip. Any violations of the minimum speed are penalized during the analysis and computation of the plan speed profile. In an embodiment, the minimum speed constraint may be applied segment-wise along the trip. Therefore, a violation of the minimum speed along one segment of the trip has no effect on other segments of the trip, and violations along the other segments can still be penalized. The minimum speed may be designated remotely, such as from a dispatch location, an operator of the vehicle system, another vehicle system on the route, or the like. For example, the minimum speed may be based on an average speed or other characteristic of a vehicle system on the route behind the vehicle system that is going to follow the generated plan speed profile.

Optionally, more than one of the pacing approaches for generating a plan speed profile described above may be used in tandem to generate a plan speed profile. Thus, one or more of the pacing speed approaches (e.g., the virtual vehicle approach, the average speed approach, and the speed difference approach) may be combined with another pacing speed approach, the arrival time approach, and/or the minimum speed approach. The different pacing approaches designate different soft constraints for use in generating the plan speed profile. For example, the minimum speed approach can be used with other pacing approaches, such as any of the pacing speed approaches and the arrival time approach. For example, referring now back to FIG. 6, the graph 700 also shows a designated minimum speed 708. Thus, the plan speed profile 702 may be generated using the speed difference approach as well as the minimum speed approach. The generated plan speed profile 702 has varying speeds over time, but the speeds are all greater than the minimum speed 708.

The EMS 206 (shown in FIG. 2) may be configured to update or add to a generated plan speed profile during a trip of the vehicle system that follows the plan speed profile.

In the embodiments described above, the EMS 206 may impose the relevant soft constraints and/or hard constraints periodically to reduce a calculation load on the EMS 206. For example, the constraints may be imposed at regular intervals, such as every quarter mile, every half mile, or another distance along the route when generating the plan speed profile to reduce the computational requirements for generating the trip plan. The distance between enforcing the constraints may be selected to have a sufficiently short length such that the vehicle is not able to exceed the speed boundaries (or other constraints) between the enforced locations. The constraints could be enforced only at block boundaries and/or signal locations. Instead of at distance intervals, the constraints may be imposed according to regular timing intervals, such as every minute, every 2 minutes, every 4 minutes, or the like. The intervals may alternatively be based on physical locations along the route, such as signal locations. Optionally, upon arriving at or passing a signal location during the trip, the EMS 206 may calculate a new or updated portion of the plan speed profile that will be used to control the movement of the vehicle system 200 along one or more upcoming blocks or segments of the route.

Referring now back to FIG. 2, after the EMS 206 generates the trip plan with the plan speed profile, the vehicle control system 201 is configured to implement the trip plan to control the movement of the vehicle system 200 along the route during the trip according to the plan speed profile. For example, the trip plan may designate tractive settings and braking settings that are implemented by the vehicle controller 202 by controlling the propulsion system 204 according to the designated tractive and braking settings. The plan speed profile accounts for other traffic on the route, such as in front of and/or behind the vehicle system 200. Thus, the vehicle control system 201 implements or follows the plan speed profile during the trip in order to pace the vehicle system 200 relative to other vehicle systems on the route. The pacing of the vehicle system 200 avoids or at least reduces the number of required stops of the vehicle system 200 due to proximity of the vehicle system 200 to another vehicle system.

In an embodiment, the EMS 206 generates the trip plan based on one or more of the constraints described above in order to pace the vehicle system 200 relative to designated meet events or pass events. For example, the trip plan may be based on an arrival time constraint that designated when the vehicle system 200 should arrive at pass location along the route that includes a siding. The arrival time constraint may be based on the anticipated movement of another vehicle system that is traveling in the opposite direction of the vehicle system 200 on the same route. By arriving at the pass location at the designated arrival time, the vehicle system 200 may enter the siding within a short time frame of the oncoming vehicle system traveling through the pass location (or vice-versa such that the oncoming vehicle system enters the siding), which reduces delays of both the vehicle system 200 and the oncoming vehicle system. The arrival time constraint and/or one or more of the pacing speed constraints may also be used to control the movement of the vehicle system 200 relative to another vehicle system on an different, intersecting route such that the vehicle system 200 arrives at the intersection between the routes at a time that is sufficiently different from the time that the other vehicle system arrives at the intersection such that neither the vehicle system 200 nor the other vehicle system is forced to stop and wait.

Optionally, the same constraints that are used to generate the trip plan for the vehicle system 200 may be used to control movement of the other (e.g., second) vehicle system as the second vehicle system moves relative to the vehicle system 200. For example, the trip plan may be generated based on a first arrival time constraint that mandates that the vehicle system 200 arrive at an intersection between the route traveled by the vehicle system 200 and the different, intersecting route traveled by the second vehicle system before a designated first time. The movement of the second vehicle system may be controlled, such as by generating a corresponding trip plan, based on a second arrival time constraint that mandates that the second vehicle system arrive at the intersection between the routes after a designated second time that is later than the designated first time. The second time is sufficiently later than the first time such that there is no risk of both vehicle systems meeting at the intersection, requiring one or both vehicle systems to slow and/or stop. The movement of the second vehicle system thus may be controlled or updated based on the same, or related, constraints that are used by the EMS 206 to generate the trip plan for the vehicle system 200. Optionally, the communication circuit 212 (shown in FIG. 2) may transmit the generated trip plan to the second vehicle system, and the second vehicle system is able to adjust its movement based on the anticipated movement of the vehicle system 200 described in the trip plan. For example, the second vehicle system may generate an updated trip plan to control movement of the second vehicle system based on the received trip plan. Alternatively, the second vehicle system may receive the same constraints or constraints that are associated with the constraints on which the trip plan for the vehicle system 200 is generated, and second vehicle system may generate an updated trip plan to control movement of the second vehicle system based on the constraints (instead of being based on a received trip plan of the vehicle system 200). Thus, the movements of the vehicle system 200 and the second vehicle system may be cooperative and iterative, such that the movements are based on common constraints and may be updated during respective trips.

Furthermore, one or more of the constraints described above, such as the arrival time constraint, may be used to control the vehicle system 200 to regulate pickup and delivery of cargo to provide more efficient utilization of cargo transfer at the source and destinations without unnecessarily long waits, such as for mine-to-port operations.

Thus, the trip plan may be generated based on an arrival time constraint and/or one or more of the pacing speed constraints such that the vehicle system 200 arrives at a cargo transfer location before or within a designated time range of at a scheduled arrival time. The scheduled arrival time may be a time that a cargo transfer facility is able to unload cargo from the vehicle system 200 or load cargo into the vehicle system 200 without the vehicle system 200 having to wait a long time at the transfer location prior to the cargo being loaded or unloaded.

Figure 8:
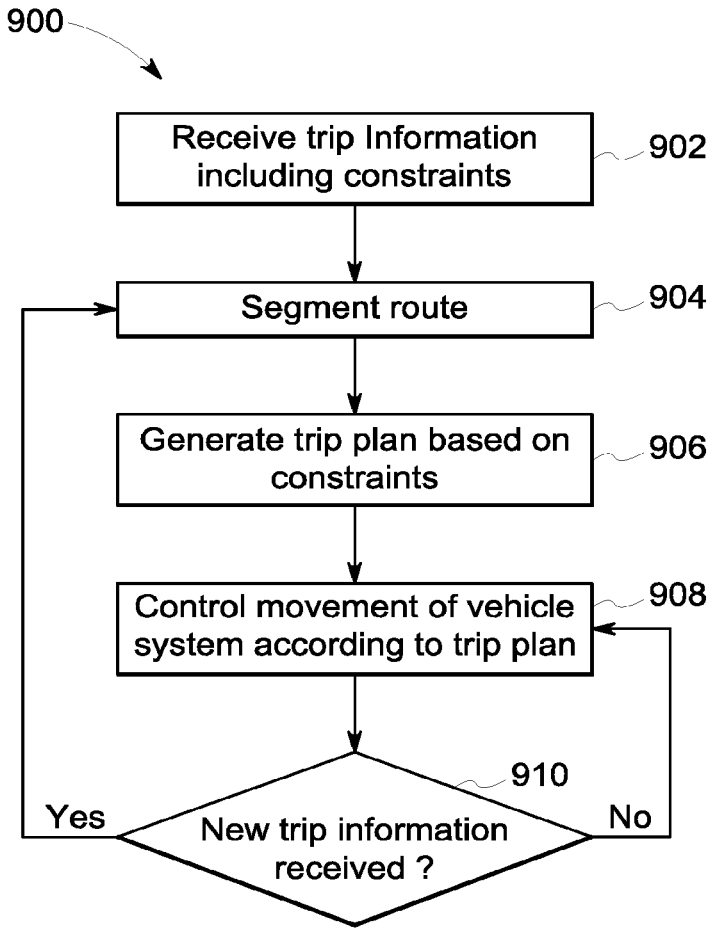
FIG. 8 is a flow chart of a method for controlling movement of a vehicle system along a route according to an embodiment.

FIG. 8 is a flow chart of a method 900 for controlling movement of a vehicle system along a route according to an embodiment. The method 900 may be performed by the EMS 206 shown in FIG. 2. For example, the EMS 206 may perform the method 900 in order to pace the vehicle system 200 during the trip to maintain at least a designated separation distance from other vehicle systems on the route that move in the same or the opposite direction of the vehicle system 200. At 902, trip information is received. The trip information may include information about the trip that can be used to generate a trip plan for controlling movement of the vehicle system 200 along the trip. For example, the trip information may include a trip schedule, route information, vehicle information, pacing parameters, and/or trip objectives. The trip information includes constraints, such as soft constraints that may be violated and hard constraints that may not be violated. The trip schedule may include a departure time, an arrival time, scheduled stops and meet/pass events, a specified path along the route, and the like. The vehicle data may include number and type of propulsion-generating vehicles, number and type of non-propulsion-generating vehicles, weight of vehicle system, type of cargo, propulsion characteristics of the propulsion-generating vehicles (such as horsepower), and the like. The route information may feature locations of crossings, switches, and work zones, grades, block boundary locations, hard speed constraints (e.g., permanent speed limits and temporary speed limits), and the like. The trip objectives may include such objectives as reducing fuel consumption, reducing total travel time, satisfying the designated arrival time, and the like. The trip information may be received at the vehicle system 200 in a message format received from an external coordinator or another vehicle system, or may be received locally within the vehicle system 200 via operator input, digital download, or the like. The external coordinator may be a person or a distributed software controller that is located remote from the vehicle system 200, such as at a dispatch center, a network coordination center, or the like.

The pacing parameters of the trip information may include information about the movement of other vehicles on the route, such as a trip plan of another vehicle, and information about desired pacing movement of the vehicle system 200 relative to other vehicles on the route, such as a designated separation distance to maintain between the vehicles. For example, the pacing parameters may include a pacing speed profile and upper and lower time-distance boundaries that can be used by the EMS 206 to generate a trip plan for the vehicle system 200 according to the virtual vehicle pacing speed approach. Furthermore, the pacing parameters may include an average speed of another vehicle on the route that can be used to generate a trip plan according to the average speed approach. The pacing parameters may include designated arrival times at various locations along the route that can be used to generate a trip plan according to the arrival time approach. In addition, or alternatively, the pacing parameters may include a minimum speed limit for the vehicle system 200. At least some of the pacing parameters may be used as soft constraints for generating a trip plan to control movement of the vehicle system 200.

At 904, the route may be segmented virtually by the EMS 206. For example, the EMS 206 may subdivide the route into multiple segments based on the trip information received and/or the one or more pacing approaches that are used to generate a trip plan. The route may be segmented based on distance and/or time of the movement of the vehicle system along the trip. The segments may be defined by actual physical items and/or locations along the route, such as block boundaries, crossings, wayside devices, and the like. The segments alternatively may be defined based on increments of time or distance. In an example, the trip information that is received may include, or be used to calculate, average speeds or arrival times of another vehicle system at designated locations along the route, and the route may be segmented based on the designated locations for use in generating a trip plan based on the average speed approach or the arrival time approach, respectively. The route optionally may also be segmented for use in other trip plan-generating approaches, including the speed difference approach and the virtual vehicle approach. By segmenting the route, a violation of a soft constraint in one segment may not affect the generation of the trip plan for other segments of the route.

At 906, a trip plan for the vehicle system 200 is generated based on the constraints and the trip information. For example, the EMS 206 may generate a trip plan using one or more of the pacing approaches described herein, including the pacing speed approaches (e.g., the speed difference approach, the virtual vehicle approach, and the average speed approach), the arrival time approach, and the minimum speed approach. The trip plan may be generated such that violations of hard constraints are omitted and violations of soft constraints are penalized. For example, the trip plan may be generated based on a cost function that is intended to be minimized, and each violation of a soft constraint results in an added weight (or cost) to a potential plan speed profile. The amount or severity of the penalty may be based on the extent of the violation. For example, if a given soft constraint is a speed difference between a plan speed profile and a pacing speed profile according to the speed difference approach, a greater difference between the speeds at a designated point of the trip results in a larger penalty (e.g., greater added cost to the cost function attributed to that plan speed profile) relative to a smaller difference between the speeds. In addition, the trip plan may also consider how well a potential plan speed profile achieves and/or improves the designated trip objectives, such as reducing fuel use and/or travel time. For example, satisfaction of the trip objectives may be rewarded (as opposed to penalized), by offsetting some of the added weight attributable to the penalties.

Multiple soft constraints may be used to generate the trip plan. A first soft constraint may be one of the soft constraints described above in FIGS. 3-7. For example, the first soft constraint may be an upper time-distance boundary according to the virtual vehicle pacing speed approach, as shown in FIG. 3. The upper time-distance boundary is defined based on a pacing speed profile of a virtual vehicle along the route. The upper boundary is violated if the plotted trajectory of a generated plan speed profile for the vehicle system 200 exceeds the upper boundary (e.g., the distance between the plan speed profile and the pacing speed profile exceeds the distance between the upper time-distance boundary and the pacing speed profile at a given time). A second soft constraint may be a lower time-distance boundary that is also based on the pacing speed profile. A third soft constraint may be matching an average speed of the plan speed profile with an average speed of the pacing speed profile at a designated location or time during the trip, as described according to the average speed approach shown in FIG. 5. A fourth soft constraint may be a difference in instantaneous speeds between the plan speed profile of the first trip plan and the pacing speed profile, according to the speed difference approach described with reference to FIG. 6. A fifth soft constraint may be an arrival time at an end location of a segment of the route according to the arrival time approach described with reference to FIG. 7. The arrival time constraint is violated responsive to the trajectory of the vehicle system, moving according to the plan speed profile, not arriving at a corresponding end location by the designated arrival time or within a designated range or window of the arrival time. A sixth soft constraint may be a minimum speed limit, which is violated upon a portion of the plan speed profile having one or more speed that are less than the minimum speed limit. Although six soft constraints are listed above, the trip plan may be generated using less than all six constraints, and may optionally include other soft constraints than the six mentioned.

In an embodiment, at least some of the approaches include multiple associated constraints. For example, a first soft constraint may be the upper time-distance boundary according to the virtual vehicle approach, and a second soft constraint may be the lower time-distance boundary. Thus, the plan speed profile violates the first soft constraint responsive to a portion of the plan speed profile crossing the upper boundary, and the plan speed profile violates the second soft constraint responsive to a portion of the plan speed profile crossing the lower boundary. In another example, a first soft constraint may be an arrival time at a first designated location along the route, and a second soft constraint may be an arrival time at a subsequent designated location along the route, both according to the arrival time approach.

Optionally, multiple different approaches may be used to generate the trip plan. For example, the trip plan may be generated based on a first soft constraint that is a speed difference between the plan speed profile and the pacing speed profile at a designated location according to the speed difference approach, and a second soft constraint that is a minimum speed limit according to the minimum speed approach.

The EMS 206 optionally may generate and/or analyze multiple potential plan speed profiles, and compare the plan speed profiles to one another based on the penalties and the rewards (e.g., for satisfying the trip objectives). The EMS 206 may generate a new or revised trip plan that has a plan speed profile with a lower weight or cost, according to the cost function, than other speed profiles that have been generated and/or analyzed.

At 908, the movement of the vehicle system 200 during the trip is controlled according to the trip plan that is generated. For example, the trip plan includes a plan speed profile that designates various speeds of the vehicle system based on distance traveled, location, and/or time along the route. The trip plan may include tractive and braking settings configured to be implemented by the vehicle control system 201 (shown in FIG. 2) to control the movement of the vehicle system 200 during the trip such that the vehicle system 200 moves according to the plan speed profile. For example, the EMS 206 may implement the trip plan by communicating control signals to the vehicle controller 202 and/or the propulsion system 204 of the vehicle system 200.

At 910, a determination is made whether new trip information is received during the trip of the vehicle system 200 along the route. For example, updated trip information may be received in a message from a dispatcher or from one or more other vehicle systems on the route. The message may be received by the communication circuit 212 and transmitted to the EMS 206. The new information may include different pacing parameters or revised trip schedule information, for example. If new trip information is received flow of the method 900 returns to 904 and the new information may be used to segment the route again. Optionally, the route may not need to be re-segmented, and the flow may continue to 906 for the trip plan to be revised or re-planned based on the new information. If, on the other hand, new information is not received, then flow of the method 900 returns to 908 and the vehicle system 200 continues to be controlled during the trip according to the generated trip plan.

Optionally, the method 900 may further include communicating the trip plan that is generated to a different, second vehicle system that is configured to travel on the same route traveled by the vehicle system 200 or another route that intersects the route traveled by the vehicle system 200. The trip plan being communicated to the second vehicle system for the second vehicle system to update movement of the second vehicle system based on the received trip plan generated for the vehicle system 200. Alternatively, instead of communicating the trip plan, the method 900 may include communicating the constraints, on which the trip plan is generated, to the second vehicle system.

In an embodiment, a system (e.g., a vehicle control system) includes an energy management system disposed onboard a first vehicle system configured to travel on a route during a trip. The energy management system has one or more processors. The energy management system is configured to receive trip information that is specific to the trip. The trip information includes one or more constraints including at least one of speed, distance, or time restrictions for the first vehicle system along the route. The energy management system is further configured to generate a trip plan for controlling movement of the first vehicle system along the route during the trip. The trip plan is generated based on the one or more constraints. The trip plan has a plan speed profile that designates speeds for the first vehicle system according to at least one of distance or time during the trip. The energy management system is further configured to control movement of the first vehicle system during the trip according to the plan speed profile of the trip plan.

Optionally, the trip information is received by the energy management system from at least one of an external coordinator, a second vehicle system, or an operator of the first vehicle system.

Optionally, the trip information includes a pacing speed profile that is based on movement of a second vehicle system on the route. The one or more constraints are based on the pacing speed profile. Optionally, the one or more constraints include an upper time-distance boundary and a lower time-distance boundary. The upper time-distance boundary has a positive offset in at least one of distance or time relative to the pacing speed profile, and the lower time-distance boundary has a negative offset in at least one of distance or time relative to the pacing speed profile. The upper and lower time-distance boundaries define a movement window therebetween. The trip plan may be generated such that the plan speed profile is generally maintained within the movement window during the trip. Optionally, the energy management system is configured to partition the trip into multiple segments based on at least one of distance or time along the route. The one or more constraints include matching an average speed of the plan speed profile with an average speed of the pacing speed profile at ends of the segments. Optionally, the energy management system is configured to generate the trip plan to reduce a difference in instantaneous speeds between the pacing speed profile and the plan speed profile of the trip plan at multiple times or locations during the trip.

Optionally, the one or more constraints include a designated minimum speed limit. The energy management system is configured to generate the trip plan such that the plan speed profile is above the minimum speed limit during the trip.

Optionally, the one or more constraints include multiple arrival times associated with corresponding designated locations along the route during the trip. The energy management system is configured to generate the trip plan such that the first vehicle system moving according to the plan speed profile arrives at the designated locations at least one of before, after, or within a designated time range of the corresponding arrival times. Optionally, the designated locations are at least one of block signal locations, block segment boundaries, siding locations, or station locations.

Optionally, the energy management system is configured to generate the trip plan to control movement of the first vehicle system during the trip to at least one of reduce fuel consumption, reduce travel time, reduce wear on the vehicle, reach a destination at a predefined time, increase throughput on a vehicle network, reduce emissions, or reduce noise relative to manual control of the first vehicle system during the trip.

Optionally, the one or more constraints of the trip information are based on movement of a second vehicle system on the route that is moving in a same direction as the first vehicle system. The trip plan is generated based on the one or more constraints and the movement of the first vehicle system is controlled according to the trip plan such that the first vehicle system maintains at least a designated separation from the second vehicle system during the trip.

Optionally, the one or more constraints of the trip information are based on movement of a second vehicle system at least one of on the route and moving in an opposite direction as the first vehicle system or on a different route that intersects the route. The trip plan is generated based on the one or more constraints and the movement of the first vehicle system is controlled according to the trip plan such that the first vehicle system at least one of passes the second vehicle system on the same route or crosses an intersection between the route and the different route at a time range that does not require the first vehicle system or the second vehicle system to stop. Optionally, the system further includes a communication circuit that communicates the trip plan that is generated based on the one or more constraints to the second vehicle system for the second vehicle system to update movement of the second vehicle system based on the trip plan generated for the first vehicle system.

Optionally, the one or more constraints of the trip information are based on a scheduled arrival time for the first vehicle system at a cargo transfer location where cargo is at least one of loaded onto the first vehicle system or unloaded from the first vehicle system. The trip plan is generated based on the one or more constraints and the movement of the first vehicle system is controlled according to the trip plan such that the first vehicle system arrives at the cargo transfer location at least one of before, after, or within a designated time range of the scheduled arrival time.

In another embodiment, a system (e.g., a vehicle control system) includes one or more processors configured to receive trip information from a communication circuit onboard a first vehicle system that is configured to travel on a route during a trip. The trip information includes a pacing speed profile that is based on movement of at least a second vehicle system on the route. The one or more processors are further configured to generate a trip plan for controlling movement of the first vehicle system along the route during the trip. The trip plan has a plan speed profile that designates speeds for the first vehicle system according to at least one of distance or time during the trip. The trip plan is generated using one or more constraints that are based on the pacing speed profile. The one or more processors are further configured to control movement of the first vehicle system during the trip according to the plan speed profile of the trip plan to ensure that the first vehicle system maintains at least a designated separation from the second vehicle system during the trip.

Optionally, the one or more processors are disposed on the first vehicle system.

Optionally, the one or more constraints include an upper time-distance boundary and a lower time-distance boundary. The upper time-distance boundary has a positive offset in at least one of distance or time relative to the pacing speed profile, and the lower time-distance boundary has a negative offset in at least one of distance or time relative to the pacing speed profile. The upper and lower time-distance boundaries define a movement window therebetween. The trip plan is generated such that the plan speed profile is generally maintained within the movement window during the trip.

Optionally, the one or more processors partition the trip into multiple segments based on at least one of distance or time along the route. The one or more constraints include matching an average speed of the plan speed profile with an average speed of the pacing speed profile at ends of the multiple segments.

Optionally, the one or more processors are configured to generate the trip plan to reduce a difference in instantaneous speeds between the pacing speed profile and the plan speed profile of the trip plan at multiple times or locations during the trip.

In another embodiment, a method (e.g., for controlling a vehicle system) includes receiving trip information specific to a trip of a first vehicle system that is configured to travel on a route during a trip. The trip information includes one or more constraints including at least one of speed, distance, or time restrictions for the first vehicle system along the route. The method includes generating a trip plan for controlling movement of the first vehicle system along the route during the trip. The trip plan is generated based on the one or more constraints. The trip plan has a plan speed profile that designates speeds for the first vehicle system according to at least one of distance or time during the trip. The method also includes controlling movement of the first vehicle system during the trip according to the plan speed profile of the trip plan.

Optionally, the one or more constraints include an upper time-distance boundary and a lower time-distance boundary that define a movement window therebetween. The trip plan is generated such that the plan speed profile is generally maintained within the movement window during the trip.

Optionally, the method further includes communicating the trip plan that is generated to a different, second vehicle system that is configured to travel on at least one of the route traveled by the first vehicle system or another route that intersects the route traveled by the first vehicle system. The trip plan is communicated to the second vehicle system for the second vehicle system to update movement of the second vehicle system based on the received trip plan generated for the first vehicle system.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose several embodiments of the inventive subject matter, and also to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, controllers or memories) may be implemented in a single piece of hardware (for example, a general purpose signal processor, microcontroller, random access memory, hard disk, and the like). Similarly, the programs may be stand-alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" or "an embodiment" of the presently described inventive subject matter are not intended to be interpreted as excluding the existence of additional embodiments that also incorporate the recited features. Moreover, unless explicitly stated to the contrary, embodiments "comprising," "comprises," "including," "includes," "having," or "has" an element or a plurality of elements having a particular property may include additional such elements not having that property.

What is claimed is:

1. A system comprising:

one or more processors configured to obtain a constraint on movement for a first vehicle system along a route, the constraint based on movement of a separate second vehicle system that is concurrently traveling along the same route, the one or more processors configured to determine a speed profile that designates speeds for the first vehicle system according to at least one of distance, location, or time based on the constraint such that the first vehicle system maintains a designated spacing from the second vehicle system along the route.

2. The system of claim 1, wherein the one or more processors are configured to obtain the constraint from at least one of an external coordinator, the second vehicle system, or an operator of the first vehicle system.

3. The system of claim 1, wherein the constraint is based on a pacing speed profile that is based on movement of the second vehicle system.

4. The system of claim 3, wherein the constraint also includes an upper time-distance boundary and a lower time-distance boundary, the upper time-distance boundary having a positive offset in at least one of distance or time relative to the pacing speed profile, the lower time-distance boundary having a negative offset in at least one of distance or time relative to the pacing speed profile.

5. The system of claim 4, wherein the upper and lower time-distance boundaries define a movement window between the upper and lower time-distance boundaries, and wherein the movement of the first vehicle system according to the plan speed profile causes the first vehicle system to move within the movement window.

6. The system of claim 3, wherein the one or more processors are configured to partition the movement of the first vehicle system into multiple segments based on at least one of distance, location, or time along the route, and wherein the constraint includes a requirement for matching an average speed of the speed profile with an average speed of the pacing speed profile at ends of the segments.

7. The system of claim 3, wherein the one or more processors are configured to determine the speed profile to reduce a difference in instantaneous speeds between the pacing speed profile and the speed profile at multiple times, distances, or locations.

8. The system of claim 1, wherein the constraint includes multiple arrival times associated with corresponding designated locations along the route, the one or more processors configured to generate the speed profile such that the first vehicle system moves according to the speed profile arrives at the designated locations within a designated time range of the corresponding arrival times.

9. The system of claim 8, wherein the designated locations are at least one of block signal locations, block segment boundaries, siding locations, or station locations.

10. The system of claim 1, wherein the one or more processors are configured to generate the speed profile to restrict the movement of the first vehicle system to at least one of reduce fuel consumption, reduce travel time, reduce wear on the first vehicle system, reach a destination at a predefined time, increase throughput on a vehicle network, reduce emissions, or reduce noise relative to manual control of the first vehicle system that maintains the designated spacing from the second vehicle system.

11. The system of claim 1, wherein the one or more processors are configured to autonomously control the movement of the first vehicle system according to the speed profile such that the first vehicle system follows the second vehicle system.

12. The system of claim 1, wherein the one or more processors are configured to direct the speed profile to be communicated to the second vehicle system for the second vehicle system to update the movement of the second vehicle system based on the speed profile.

13. The system of claim 1, wherein the constraint is based on a scheduled arrival time of the first vehicle system at a cargo transfer location where cargo is at least one of loaded onto the first vehicle system or unloaded from the first vehicle system.

14. A system comprising:

one or more processors configured to receive trip information from a first vehicle system that is configured to travel on a route, the trip information including a pacing speed profile that is based on movement of at least a second vehicle system on the same route, the one or more processors further configured to generate a plan speed profile for controlling movement of the first vehicle system along the route, the plan speed profile designating speeds for the first vehicle system according to at least one of distance, location, or time, the plan speed profile generated using one or more constraints based on the pacing speed profile, wherein the one or more processors also are configured to automatically control movement of the first vehicle system according to the plan speed profile to ensure that the first vehicle system maintains at least a designated separation from the second vehicle system on the route.

15. The system of claim 14, wherein the one or more processors are disposed on the first vehicle system.

16. The system of claim 14, wherein the one or more constraints include an upper time-distance boundary and a lower time-distance boundary, the upper time-distance boundary having a positive offset in at least one of distance, location, or time relative to the pacing speed profile, the lower time-distance boundary having a negative offset in at least one of distance, location, or time relative to the pacing speed profile, the upper and lower time-distance boundaries defining a movement window therebetween.

17. The system of claim 16, wherein the one or more processors are configured to generate the plan speed profile such that the movement of the first vehicle system is maintained within the movement window.

18. The system of claim 14, wherein the one or more processors are configured to partition the trip into multiple segments based on at least one of distance, location, or time along the route, the one or more constraints including matching an average speed of the plan speed profile with an average speed of the pacing speed profile at ends of the multiple segments.

19. The system of claim 15, wherein the one or more processors are configured to generate the plan speed profile to reduce a difference in instantaneous speeds between the pacing speed profile and the plan speed profile at multiple times or locations.

20. A method comprising:

receiving trip information specific to a trip of a first vehicle system that is configured to travel on a route during a trip, the trip information including one or more constraints for movement of the first vehicle system along the route;

generating a plan speed profile for controlling movement of the first vehicle system along the route during the trip, the trip plan generated based on the one or more constraints, the plan speed profile designating speeds for the first vehicle system according to at least one of distance, locations, or time during the trip; and controlling movement of the first vehicle system during the trip according to the plan speed profile such that the first vehicle system maintains a designated spacing from a separate second vehicle system concurrently moving on the same route.

* * * * *